US007021185B2

(12) United States Patent
Cote et al.

(10) Patent No.: US 7,021,185 B2
(45) Date of Patent: Apr. 4, 2006

(54) REGISTRATION APPARATUS FOR A SHEET MATERIAL ARTICLE HANDLER

(75) Inventors: Kevin Lauren Cote, Durham, NH (US); Richard Daniel Curley, Dover, NH (US); Benedict Sammuel Raffaele, Union, OH (US)

(73) Assignee: Goss International Americas, Inc., Dover, NH (US)

( * ) Notice: Subject to any disclaimer, the term of this patent is extended or adjusted under 35 U.S.C. 154(b) by 336 days.

(21) Appl. No.: 10/002,015

(22) Filed: Oct. 26, 2001

(65) Prior Publication Data

US 2003/0079591 A1 May 1, 2003

(51) Int. Cl.
*B26D 7/06* (2006.01)
*B65H 9/00* (2006.01)

(52) U.S. Cl. ..... 83/268; 83/278; 83/904; 83/934; 271/245

(58) Field of Classification Search ..... 83/412, 83/415, 423, 733, 409, 410, 467.1, 904, 934, 83/419, 268, 278, 468.6; 271/226, 233, 234, 271/236, 239, 244, 245

See application file for complete search history.

(56) References Cited

U.S. PATENT DOCUMENTS

| | | | | | |
|---|---|---|---|---|---|
| 1,327,915 | A | * | 1/1920 | Kast | 83/251 |
| 2,763,324 | A | * | 9/1956 | Loverch et al. | 83/239 |
| 3,570,344 | A | * | 3/1971 | Bryson et al. | 83/155 |
| 3,733,947 | A | | 5/1973 | Bryson et al. | 83/280 |
| 3,830,354 | A | * | 8/1974 | Sarring | 198/626.6 |
| 4,436,469 | A | * | 3/1984 | Kelly | 412/16 |
| 5,147,092 | A | * | 9/1992 | Driscoll et al. | 271/245 |
| 5,311,801 | A | * | 5/1994 | Uno | 83/278 |
| 5,374,044 | A | * | 12/1994 | Belec et al. | 271/283 |
| 5,472,181 | A | * | 12/1995 | Lowell | 270/58.09 |
| 5,660,515 | A | * | 8/1997 | Hartsoe | 412/1 |

* cited by examiner

*Primary Examiner*—Stephen Choi
(74) *Attorney, Agent, or Firm*—Davidson, Davidson & Kappel, LLC

(57) ABSTRACT

A registration device for a sheet material article handler includes a movable backstop which sequentially engages a leading edge portion of a sheet material article as the article moves in a direction of movement along a path of movement in the sheet material article handler, thereby registering the sheet material article relative to the sheet material article handler. A driver is provided, the driver moving the backstop along an arcuate path in the direction of movement of the sheet material article from a first position out of the path of movement to a second position in the path of movement.

12 Claims, 12 Drawing Sheets

42
104
54
306
304
44
292
282
300
290
284

REGISTRATION APPARATUS FOR A SHEET MATERIAL ARTICLE HANDLER

BACKGROUND

The present invention relates generally to devices used to sequentially process sheet material articles, and in particular to a registration apparatus for a sheet material article handler.

Apparatus which handle sheet material articles include trimmers and printers. In such apparatus, registration of the sheet material articles is performed before a trimming or printing operation, for example. Backstops which move in and out of the path of the sheet material articles may be used to perform the registration function.

In a known apparatus for trimming sheet material articles, such as books, a front knife assembly trims front edge portions of the books. A shuttle pushes each of the books in turn onto the moving front knife table of the apparatus. As the book moves onto the moving table, a leading edge or back of the book engages backstops which register the book relative to the front knife. After the front knife trimming operation, the backstops retract out of the path of the book so that the book may be moved onto the side knife assembly. The backstops travel in a substantially vertical motion in and out of the path of the book as it travels through the trimmer. The backstops travel from below the book path up into the book path, and then back down out of the book path.

The cycle time of the backstops to get into and out of position limits the speed at which books can move through the trimmer. The up-motion of the backstops cannot start until the entire book has cleared the backstops location. Similarly, the book cannot move past the backstop location until the backstops are completely down and out of the book path.

The above-described known apparatus for trimming books or other sheet material articles is disclosed in U.S. Pat. No. 3,733,947 issued May 22, 1973 and entitled "Book Trimming Machine". An apparatus for trimming books and other sheet material articles and constructed as disclosed in this patent has been commercially available from Harris Graphics, a division of AM International, of 4900 Webster Street, Dayton, Ohio 45414 and is referred to as the HT-15 Trimmer.

SUMMARY OF THE INVENTION

The present invention provides registration apparatus and method for a sheet material article handler. The apparatus and method according to the present invention may be used in a trimmer or a printer for books formed by a plurality of signatures, as well as for other sheet material articles.

The registration apparatus according to the present invention includes a movable backstop configured to sequentially engage a leading edge portion of a sheet material article moving in a direction of movement of the sheet material article along a path of movement of the sheet material article in the sheet material article handler so as to register the sheet material article relative to the sheet material article handler. A driver is provided, the driver being configured to move the backstop along an arcuate path in the direction of movement of the sheet material article from a first position out of the path of movement to a second position in the path of movement.

The method for registering a sheet material article according to the present invention includes sequentially engaging, using a movable backstop, a leading edge portion of a sheet material article moving in a direction of movement of the sheet material article along a path of movement of the sheet material article in the sheet material article handler so as to register the sheet material article relative to the sheet material article handler; and moving the backstop along an arcuate path in the direction of movement of the sheet material article from a first position out of the path of movement to a second position in the path of movement using a driver.

Following its arcuate path, the backstop according to the present invention moves into position as a book is approaching the backstop location. The tip of the backstop enters the path of the books between two adjacent books. The arcuate movement of the backstop brings the backstop up just behind the first book and just ahead of the second book. Similarly, the backstop continues to follow the arcuate path to move away from their up-position so that the book can start to move before the backstop is completely in its down position.

DETAILED DESCRIPTION

Figure 1:
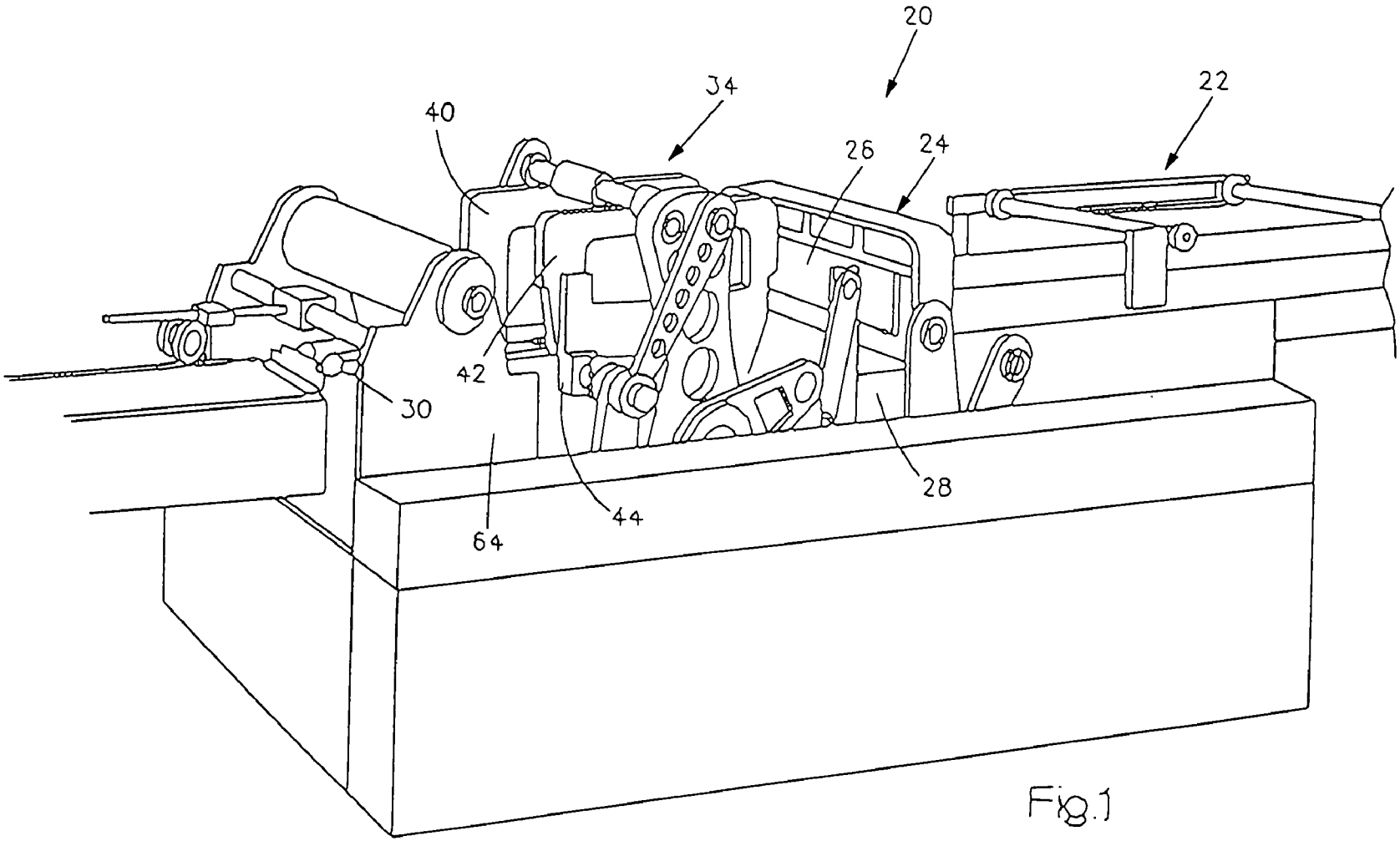
FIG. 1 is a simplified pictorial illustration of an apparatus which is constructed and operated in accordance with the present invention to trim sheet material articles.

A sheet material trimming apparatus 20 (FIG. 1) constructed and operated in accordance with the present invention may be used to trim books or other sheet material articles having either uniform thicknesses or thicknesses which vary within a range of thicknesses. Thus, the apparatus 20 may be used to trim a relatively thick article in a range of thicknesses. Immediately thereafter, the apparatus 20 may be used to trim a relatively thin article in the range of thicknesses without adjusting the apparatus. Even though the thickness of the sheet material articles may vary within the range of thicknesses, very high quality front and side trims are obtained.

In one specific instance, the apparatus 20 was used to trim books having an unclamped thickness in a range of 1.67 to 1.11 inches or a clamped thickness in a range of 1.25 to 0.75 inches. Of course, the apparatus 20 could be used to trim books or other sheet material articles having thicknesses in a different range of thicknesses. The thick and thin books were sequentially trimmed without regard to variations in the thicknesses of the books and without adjusting the apparatus 20. Thus, a thin book can be trimmed immediately after a thick book, and vice-versa, with excellent trim quality.

The apparatus 20 may be used to trim books formed by a plurality of signatures. Moreover, the apparatus 20 could be used to trim other sheet material articles. It should also be understood that although the construction and mode of operation of the apparatus 20 makes it particularly advantageous when the thickness of the sheet material articles to be trimmed varies from one article to the next within a range of thicknesses, the apparatus 20 could be used to trim articles which all have the same thickness.

The apparatus 20 (FIG. 1) includes an infeed section 22 from which books or sheet material articles are sequentially fed to a front trimmer assembly 24. The front trimmer assembly 24 registers the back or leading edge of a book relative to a front trim knife 26. While the front knife 26 is moving with a front table 28, the front knife 26 trims a trailing or front edge portion of the book or other sheet material article.

A transfer belt assembly 30 extends through the apparatus 20 from the front trimmer assembly 24 through a side trimmer assembly 34 to a receiving conveyor 36. The transfer belt assembly 30 sequentially moves partially trimmed books or other sheet material articles from the front trimmer assembly 24 to the side trimmer assembly 34. The transfer belt assembly 30 then moves fully trimmed books to the receiving conveyor 36.

The side trimmer assembly 34 includes a pair of side knives 40 and 42. The side knives 40 and 42 are moveable relative to a side table 44 to trim opposite side edge portions, that is, the head and tail, of a book or other sheet material article. Although the front and side trimmer assemblies 24 and 34 may be used together in a single machine or apparatus 20, either the front trimmer assembly or side trimmer assembly could be used by itself without the other trimmer assembly if desired.

Figure 4:
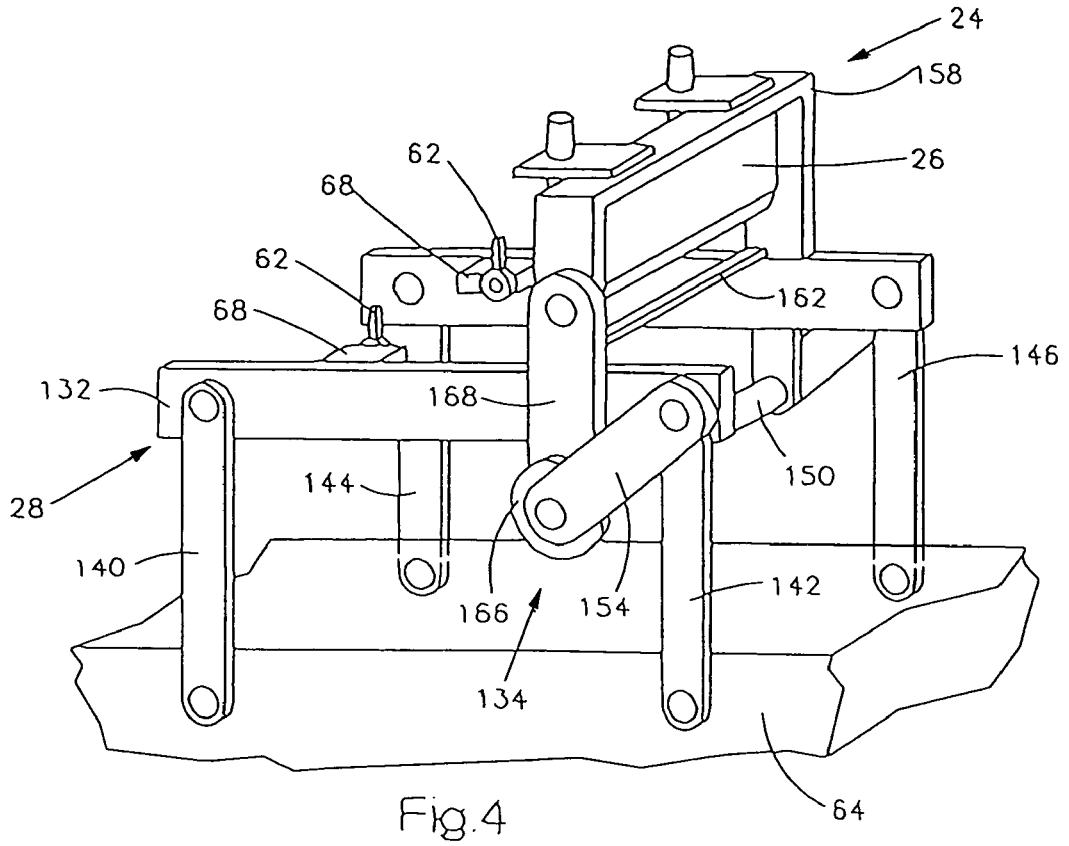
FIG. 4 is a schematic illustration of a front trimmer assembly of the apparatus of FIG. 1.
Figure 5:
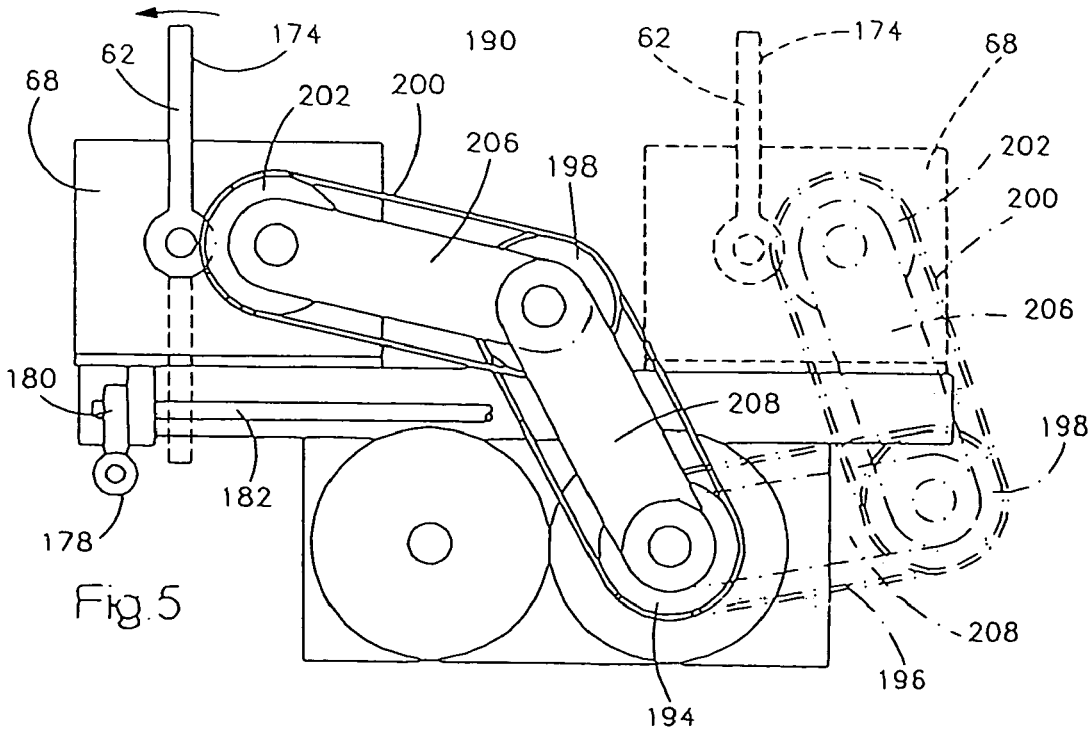
FIG. 5 is a schematic illustration of a backstop drive system used in the front trimmer assembly of FIG. 4.
Figure 14:
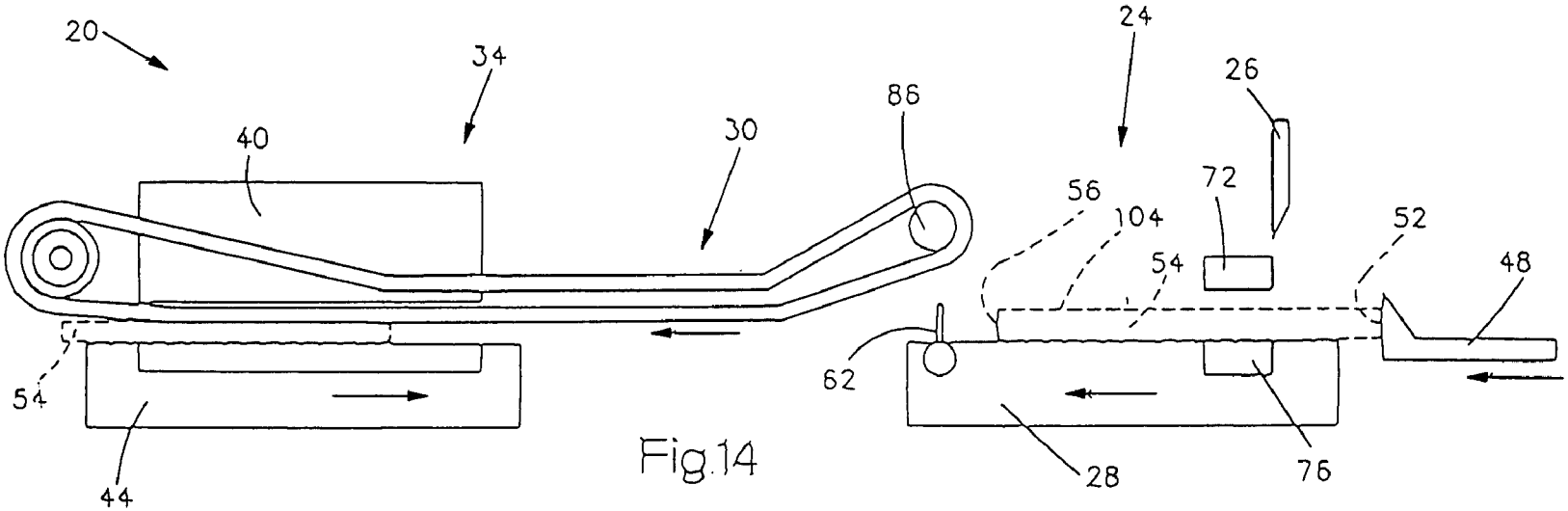
FIG. 14 illustrates the relationship between front and side tables in the apparatus of FIG. 1 as an untrimmed sheet material article moves onto the front table and as a fully trimmed sheet material article moves from the side table.
Figure 15:
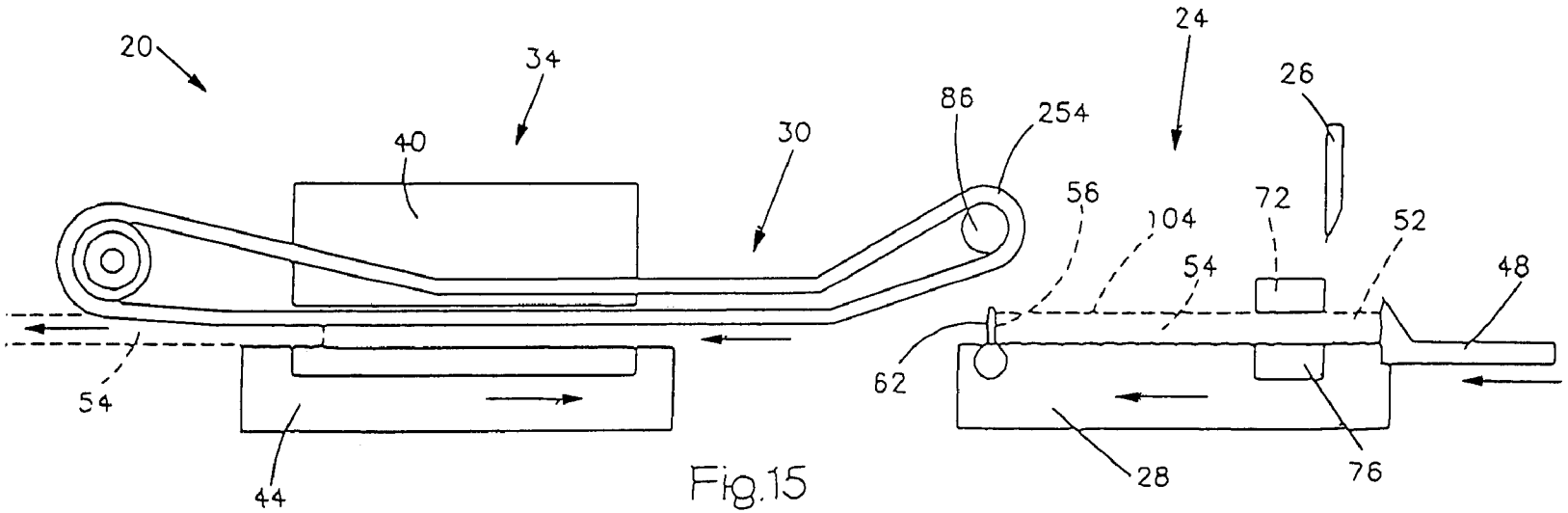
FIG. 15 is a schematic illustration, generally similar to FIG. 14, illustrating the relationship between the front and side tables as an untrimmed sheet material article is clamped at the front table and a fully trimmed sheet material article is moved from the side table.

The infeed section 22 sequentially transports untrimmed books, having thicknesses which may vary within a range of thicknesses, to the front trimmer assembly 24. The infeed section 22 includes a shuttle or infeed element 48 (FIG. 2) which is moved with a reciprocating action to sequentially push untrimmed books or other sheet material articles into the front trimmer assembly 24 (FIG. 1). The motion of the shuttle 48 may include both horizontal and vertical components. The shuttle 48 pushes against the trailing or front edge portion 52 of a book 54 in the manner illustrated schematically in FIG. 14. The shuttle 48 moves a leading or back edge portion 56 of the book 54 into engagement with backstops 62 (FIGS. 4, 5 and 15).

The front knife 26 and backstops 62 are disposed on the front table 28. The front table 28 reciprocates through forward and return strokes relative to a base 64 (FIGS. 1 and 4) of the apparatus 20. Thus, the front trimmer assembly 24 is of the flying shear type in which a book is trimmed while it is moving relative to the base 64.

In accordance with a feature of the present invention, the backstops 62 rotate in the direction of movement of the books 54 through the apparatus 20. Thus, the backstops 62 are rotated in a counterclockwise direction (as viewed in FIGS. 4 and 5). This results in the backstops 62 moving from a retracted condition (FIG. 18) beneath the path of travel of the books 54 to an extended condition (FIG. 15) extending into the path of travel of the books in the same direction as the direction of movement of the books along their path of travel.

The backstops 62 follow a partially trimmed book 54 as the backstops enter the space between the partially trimmed book leaving the front trimmer assembly 24 and an untrimmed book entering the front trimmer assembly. Since the backstops 62 move in the same direction as the books 54, relatively little space is required between the books to allow the backstops to move to an extended position in the path of travel of the books.

The backstops 62 are rotatable through a complete circle. The backstops 62 rotate counterclockwise from the extended position shown in solid lines in FIG. 5 to a lowered or retracted position shown in dashed lines. The backstops 62 are subsequently rotated, in the counterclockwise direction, from the retracted position shown in dashed lines to the extended position shown in solid lines.

Figure 6:
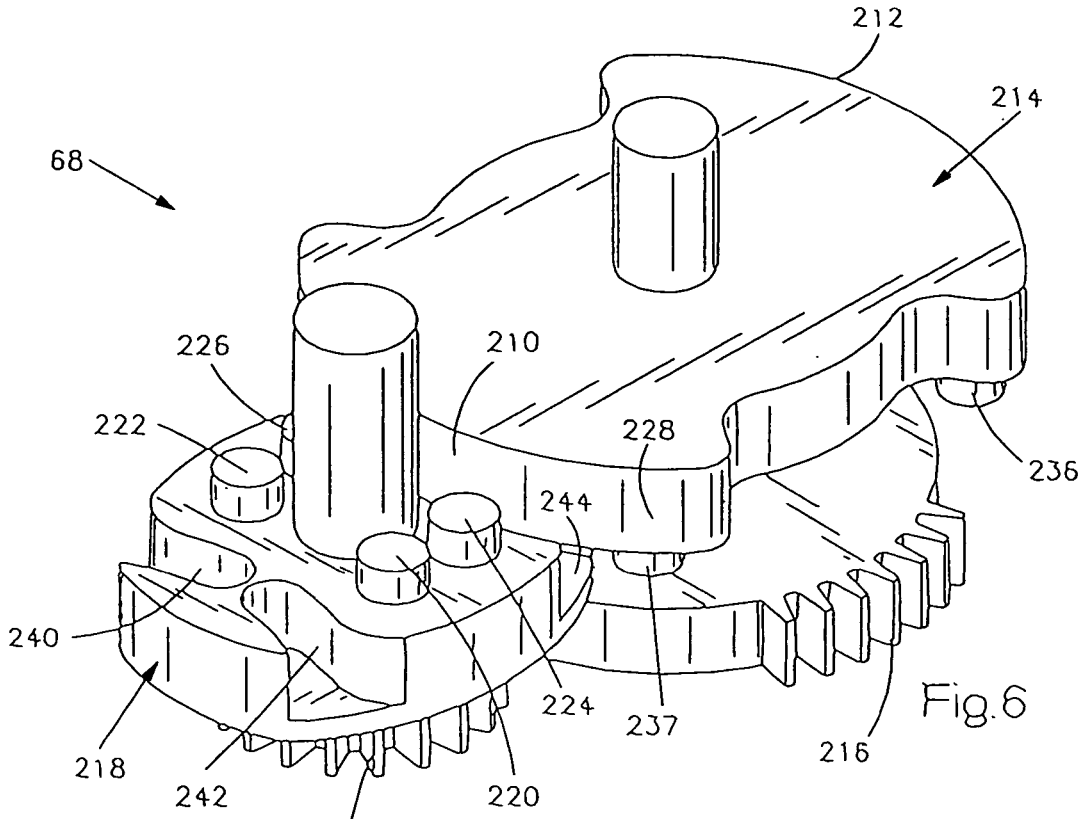
FIG. 6 is a pictorial illustration of components of an intermittent drive mechanism used in the backstop drive system of FIG. 5 to rotate the backstops.
Figure 7:
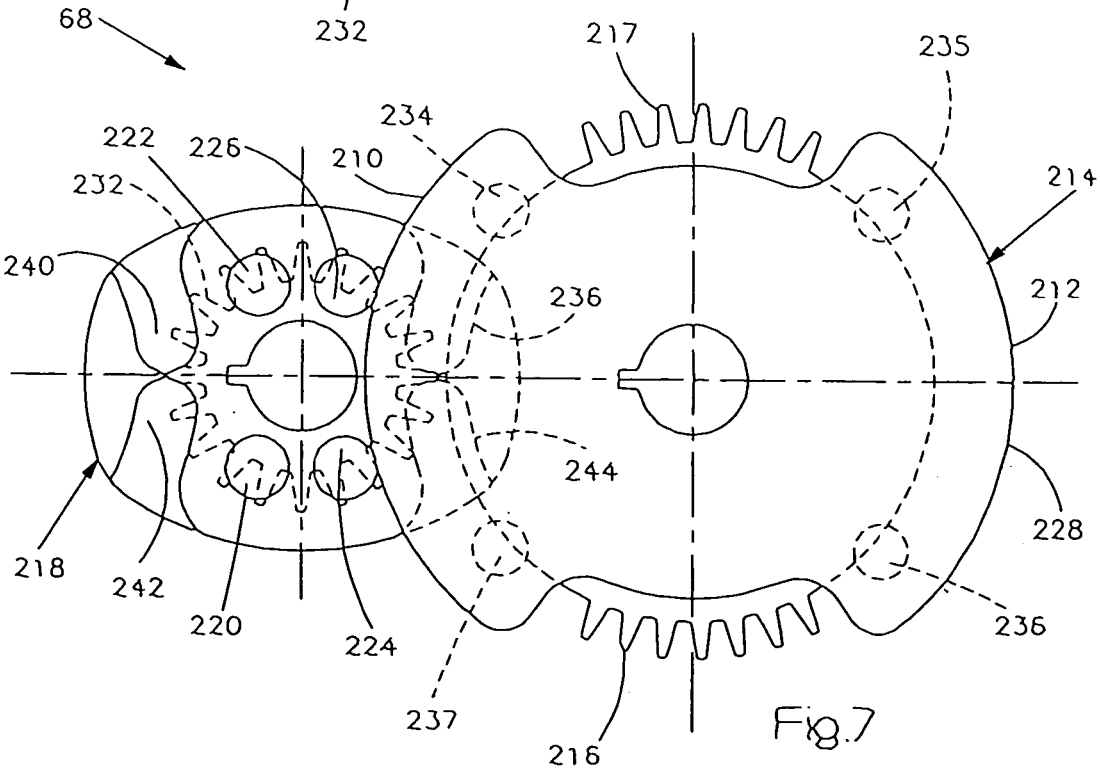
FIG. 7 is a schematic illustration depicting the relationship between various components of the intermittent drive mechanism of FIG. 6.

The backstops 62 are rotated by an intermittent motion mechanism 68 (FIGS. 5, 6 and 7). The intermittent motion mechanism 68 is operable to perform the dual functions of rotating the backstops 62 between the extended and retracted positions and of locking the backstops in each of the positions in turn until the backstops are to be moved. Although the backstops 62 are described in association with the movable front table 28, the backstops could be used in association with a stationary support in a sheet material handling apparatus which may or may not be a trimmer.

When the back or leading end portion 56 (FIG. 15) of a book 54 engages the raised backstops 62, the speed and direction of movement of the table 28 and shuttle 48 are the same. Thus, due to the matched velocity of the shuttle 48 and table 28, the book 54 is securely held between the shuttle and the backstops 62. This eliminates any possibility of rebound of the book 54 from the backstops 62 and holds the book 54 in a predetermined position relative to the front knife 26 and table 28.

Figure 8:
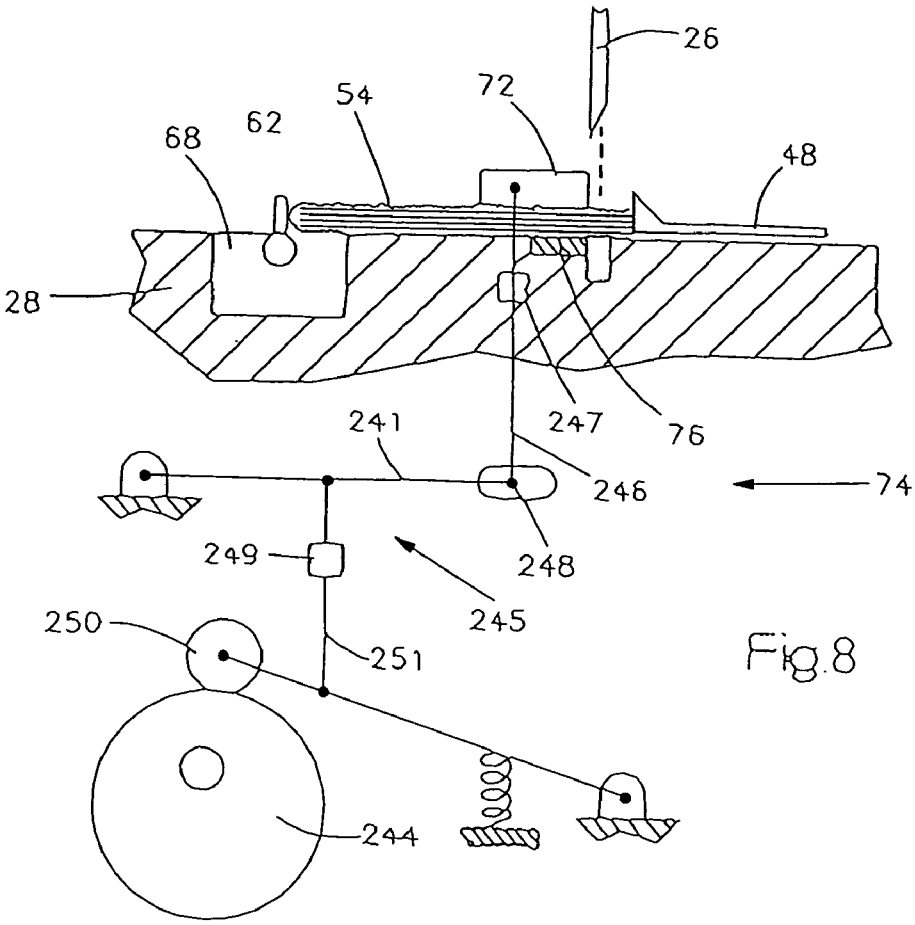
FIG. 8 is a highly schematicized illustration depicting a front clamp drive mechanism used in the front trimmer assembly of FIG. 4.

The shuttle 48 holds a book 54 against the backstops 62 for a period of time which is at least sufficient to enable a front clamp 72 (FIG. 8) to move through a distance corresponding to the difference between the thickness of the thickest book in a range of thicknesses and the thinnest book in the range of thicknesses. While the book 54 is held between the backstop 62 and the shuttle 48, the front clamp 72 (FIG. 8) is moved downwardly from a raised or release position by a drive mechanism 74. The drive mechanism 74 moves the upper front clamp 72 downwardly toward the table 28 to grip the book 54 between the upper clamp and a lower clamp 76 connected with the front table 28 (FIGS. 8, 14 and 15).

The thickness of the book or other sheet material article 54 can vary within a range of thicknesses. Therefore, the speed and direction of movement of the shuttle 48 (FIG. 15) matches the speed and direction of movement of the front table 28 and backstops 62 for a period of time which is long enough for the front clamp 72 to move through a distance which is at least as great as the difference between the thickness of the thickest sheet material article 54 in the range of thicknesses and the thinnest sheet material article in the range of thicknesses. Therefore, the shuttle 48 will hold the book 54 against the backstops 62 for a period of time which is sufficient to enable the upper clamp member 72 to clamp the thinnest book in the range of thicknesses.

If the book 54 is relatively thick, the clamp member 72 will quickly grip the book after a minimum of movement relative to the table 28. However, if the book 54 is relatively thin, a longer time will be required for the clamp member 72 to grip the book. Therefore, the shuttle 48, table 28 and backstops 62 (FIG. 15) move at the same velocity to hold the leading or back edge portion 56 of the book against the backstops for a substantially longer period of time than is required to clamp the thickest book in the range of thicknesses. The period of matched table and shuttle velocity is necessary to provide for the accurate trimming of books 54 of different thicknesses.

If the period of matched velocity of the table 28 and shuttle 48 ended before the upper front knife clamp 72 moves downwardly to grip a book, the book could move and the quality of the trim would be relatively poor. Therefore, the matched velocity period is equal to or greater than the time required for the front clamp 72 to travel the maximum distance to engage a book of minimum thickness. For example, if the range of book thicknesses is from 1.67 inches to 1.11 inches, the period of time for the velocity match between the shuttle 48 and front table 28 is at least as long as is required for the front clamp 72 to move through 0.56 inches. Of course, if books having a different range of thickness are to be trimmed, the period of time for the velocity match between the shuttle 48 and the front table 28 may be different.

Figure 16:
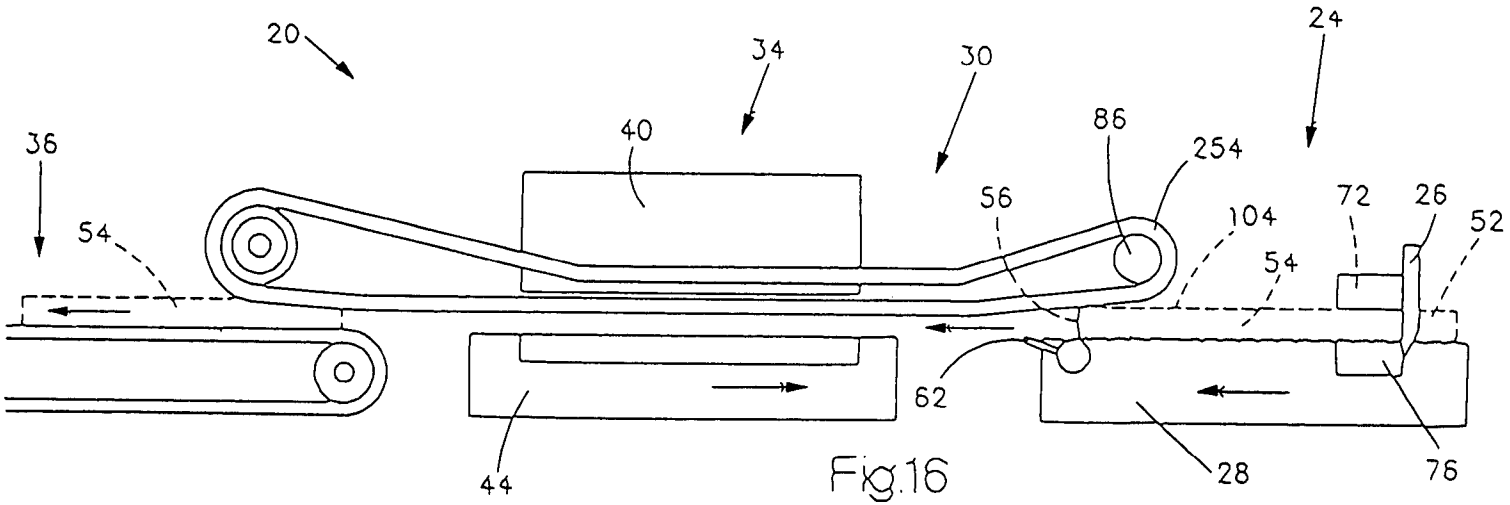
FIG. 16 is a schematic illustration, generally similar to FIGS. 14 and 15, illustrating the relationship between the front table and side table immediately after completion of a front trimming operation and after movement of a fully trimmed book to a receiving conveyor assembly.

After the front clamp 72 has gripped the book 54, the front knife 26 moves down to trim the front edge portion 52 of the book (FIG. 16). As the book is being trimmed, the backstops 62 begin to rotate from their raised or extended position (FIG. 15) toward the retracted position shown in dashed lines in FIG. 5.

After the front edge portion of the book 54 has been trimmed, the transfer belt assembly 30 (FIG. 9) grips the book 54. To grip the book, a leading end or nip forming portion 86 of the transfer belt assembly 30 moves from the raised position shown in FIG. 14 to the lowered or engaged position shown in FIG. 9. Thus, prior to lowering of the backstops 62 and trimming of the book 54 on the front table 28, the transfer belt assembly 30 is raised and does not engage the book.

Figure 9:
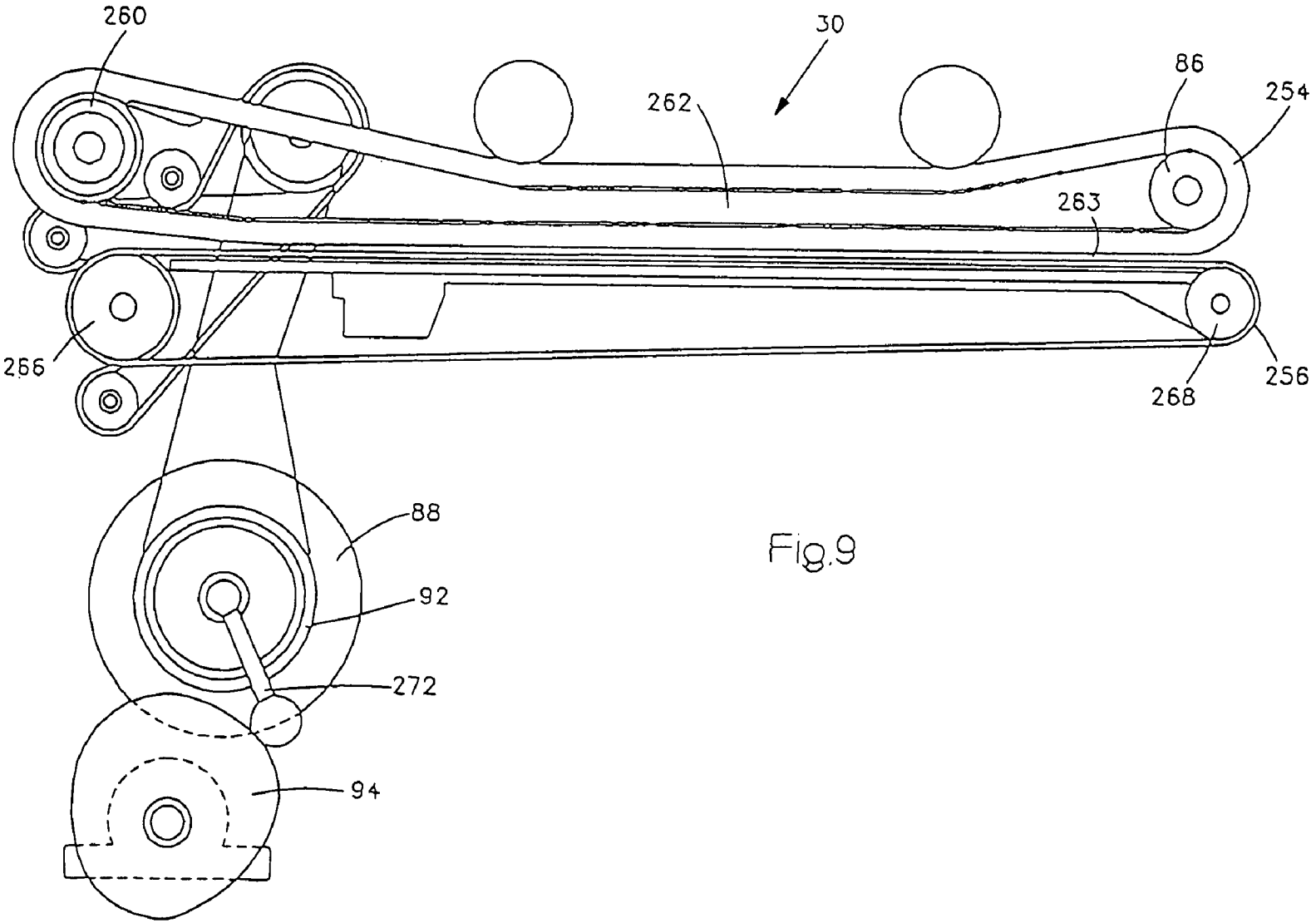
FIG. 9 is a schematic illustration depicting the construction of a transfer belt assembly used to transfer sheet material articles from a front trimmer assembly to a side trimmer assembly and from the side trimmer assembly to a receiving conveyor in the apparatus of FIG. 1.

The speed and direction of movement of the transfer belts in the transfer belt assembly 30 matches the speed and direction of movement of the front table 28 as the transfer belts engage a partially trimmed book 54 on the front table. To provide for the matched speed between the transfer belts and the front table 28, the transfer belts are driven through an epicyclic gear unit 88 (FIG. 9). The epicyclic gear unit matches the velocity of the transfer belts to the velocity of the front table 28 during engagement of a partially trimmed book 54 on the front table by the transfer belts.

The epicyclic gear unit 88 has a pair of rotatable input members, that is a constant speed input member and a variable speed input member. The epicyclic gear unit 88 has a gear train which combines the two rotational inputs to drive an output member or sprocket 92 at a speed which is a function of the speeds of the two inputs. The constant speed input to the epicyclic gear unit 88 is driven from the main trimmer drive (not shown). The variable speed input to the epicyclic gear unit 88 is driven by a cam 94 which is rotated at a constant speed by the main trimmer drive.

Figure 17:
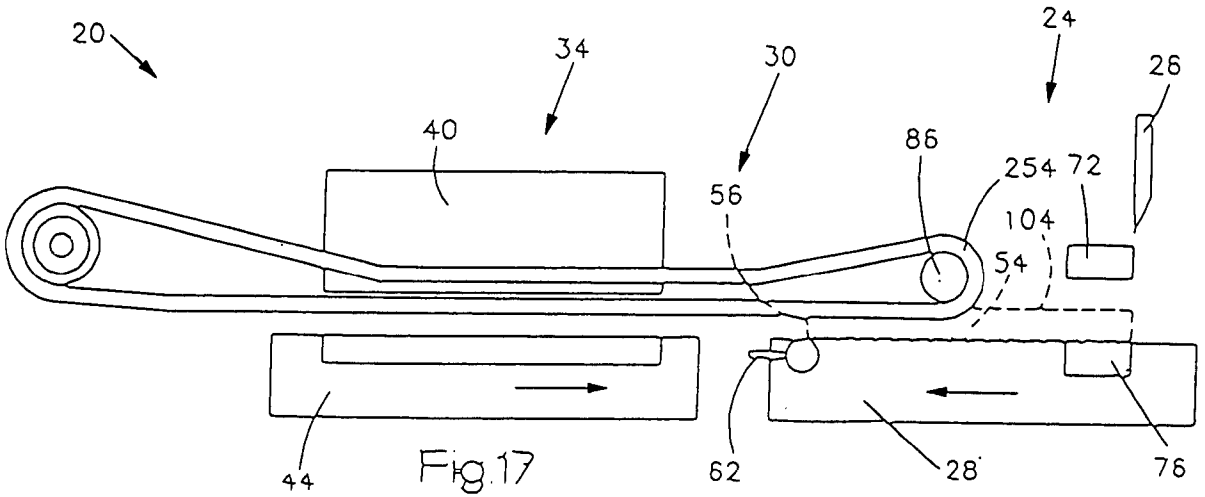
FIG. 17 is a schematic illustration, generally similar to FIG. 16, illustrating the relationship between the front and side tables after a front clamp has been released, the front knife raised, and the backstops partially retracted.
Figure 18:
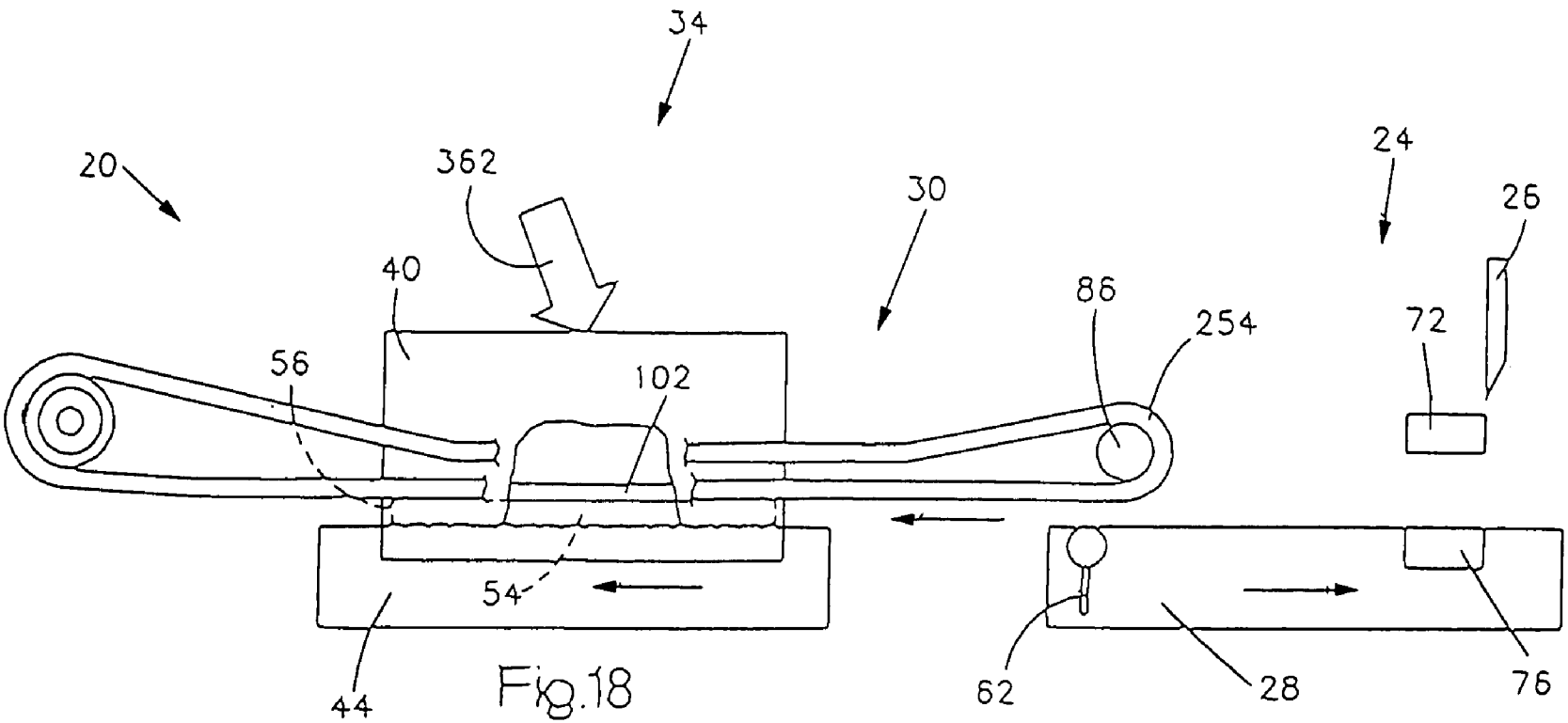
FIG. 18 is a schematic illustration, generally similar to FIG. 17, illustrating the relationship between the front table and side tables during trimming of a book at the side table and movement of the front table during a return stroke.

As the transfer belt assembly 30 grips a partially trimmed book 54 moving with the front table 28 (FIG. 16), the front clamp member 72 is raised to release the partially trimmed book for movement from the front table 28 (FIG. 17). The transfer belt assembly 30 is then driven at a speed which does not match the speed of the front table 28. At this time, the transfer belts move the partially trimmed book 54 from the front table 28 to the side table 44 (FIG. 18). While the book 54 is on the side table 44, the book is gripped and moved by the transfer belt assembly 30.

The velocity of the transfer belts in the transfer belt assembly 30 matches the velocity of the side table 44 during trimming of opposite side portions of the book 54 by the side knives 40 and 42 (FIG. 1). Thus, the book 54 is moved onto and accurately positioned relative to the side table 44 by the transfer belt assembly 30. The transfer belts in the transfer belt assembly 30 then move at the same speed and in the same direction as the side table 44 as the book is clamped, cut and then unclamped. Although belts may be used to transfer the books 54 between the front and side tables 28 and 44, other known transfer elements, such as a shuttle mechanism, could be used if desired.

Figure 10:
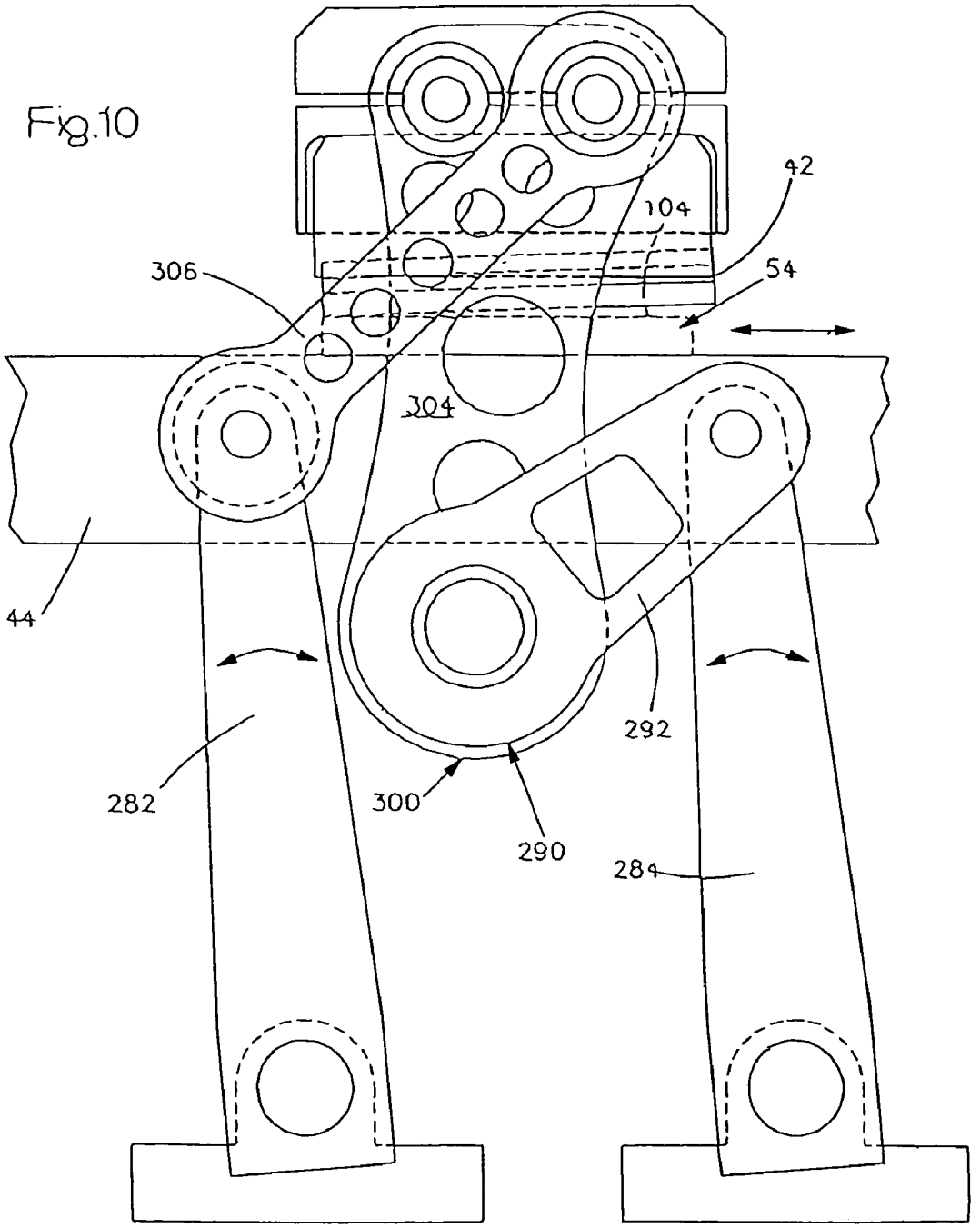
FIG. 10 is a somewhat schematicized side elevational view illustrating the construction of a side trimmer assembly.

A pair of side clamps 102 (FIG. 11) are simultaneously moved downwardly by a drive mechanism 106 to grip the book 54 and hold the book against movement relative to the side table 44 (FIG. 10). The side clamps 102 hold the book 54 against movement relative to the side table 44 during cutting of the book by the side knives 40 and 42. Although only one of the side clamps 102 has been shown in FIG. 11, it should be understood that a separate side clamp is associated with each side knife 40 and 42.

The side knives 40 and 42 are moved to trim opposite edge portions of a book 54 with a shearing action. Thus, the side knives 40 and 42 move downward and in an edgewise direction relative to a book 54. The side knives 40 and 42 each move along a path having a vertical component which is perpendicular to a major side surface 104 (FIG. 14) of a book 54 and a horizontal component which is parallel to the major side surface 104 of the book. This results in the side knives 40 and 42 cutting the opposite edge portions of the book 54 with a sharp shearing action which promotes a high quality trim in the finished product. It should be understood that the book 54 and side knives 40 and 42 are moving with the side table 44 relative to the base 64 during trimming of the book.

After the side clamps 102 have been released, the transfer belt assembly 30 moves the fully trimmed book 54 from the side table 44 to the receiving conveyor 36. In accordance with a feature of the present invention, when the book 54 is released from the transfer belt assembly 30 for movement with the receiving conveyor 36, the speed of movement of the book 54 is matched to the speed of the receiving conveyor. This promotes a smooth transfer of the fully trimmed book from the trimming apparatus 20 to the receiving conveyor 36.

Infeed Shuttle

The infeed shuttle or pusher 48 (FIG. 2) engages a book 54 (FIG. 14) to be trimmed and pushes the book from the infeed section 22 (FIG. 1) into the front trimmer assembly 24. After the book has been pushed into abutting engagement with the backstops 62 (FIG. 15) in the front trimmer assembly 24, the shuttle 48 matches the velocity of the book to the velocity of the front table 28 until the book has been gripped by the front clamp 72. The shuttle 48 is then retracted (moved toward the right as viewed in FIG. 2) to engage a next succeeding book to be trimmed. When the book 54 is relatively thick, the front clamp 72 will have engaged the book and the front knife 26 will have started to cut the book before the shuttle 48 is retracted.

Figure 3:
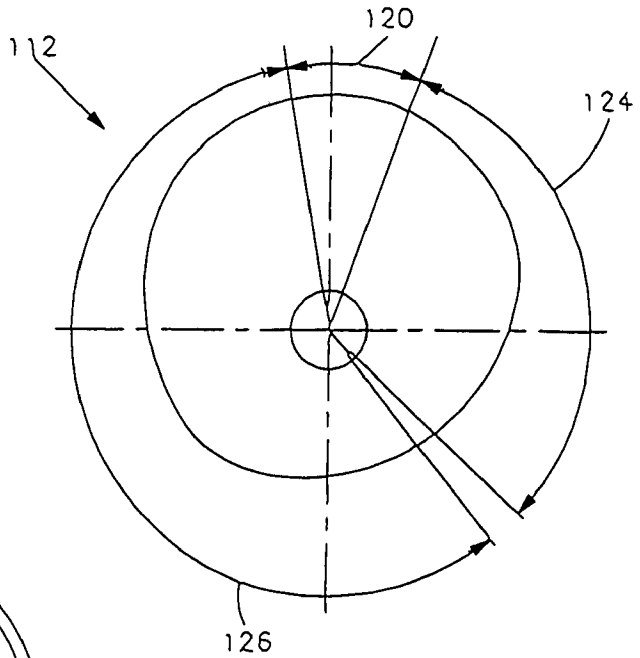
FIG. 3 is a side view of a cam used to move the shuttle of FIG. 2.

A main cam 112 (FIGS. 2 and 3) is rotated by the main trimmer drive to effect movement of the shuttle 28 through forward and return strokes. A secondary cam 114 (FIG. 2) is connected with the main cam 112 and is also driven by the main trimmer drive. The secondary cam 114 lowers the shuttle 48 as the shuttle is moved through the return stroke. Lowering of the shuttle 48 as it moves through the return stroke allows upwardly projecting ends 116 of shuttle pusher fingers to move beneath a next succeeding book.

Once the upwardly projecting ends 116 of the shuttle pusher fingers have moved rightwardly (as viewed in FIG. 2) past the trailing edge portion of the next succeeding book 54, the secondary cam 114 raises the shuttle. The main cam 112 then effects forward movement of the shuttle 48. As the shuttle 48 moves forwardly, the upwardly projecting ends 116 of the pusher fingers press against the trailing end portion or front 52 of the book 54 and move the book toward and onto the front table 28.

When the leading end portion or back 56 of the book 54 has engaged the backstops 62 on the front table 28, the main cam 112 matches the velocity of the shuttle 48 to the velocity of the front table 28. The leading end portion 56 of the book 54 is held against the backstops 62 by the shuttle 48 (FIG. 16). The velocity of the shuttle 48 matches the velocity of the front table 28 to hold the book 54 against the backstops 62 for a period of time which is at least as great as the time required for the front clamp 72 to move through a distance corresponding to the difference between the thickest book in the range of thicknesses and the thinnest book in the range of thicknesses. In this way, positive control of the book is maintained through gripping of the book by the front clamp 72.

The general construction of the shuttle 48 is the same as is disclosed in the aforementioned U.S. Pat. No. 3,733,947. However, the configuration of the main cam 112 is different than the configuration of the main cam used with the shuttle assembly disclosed in the aforementioned patent. Unlike the main cam in the patent, the main cam 112 is configured to match the shuttle velocity to the front table velocity as previously explained.

The main cam 112 includes an arc 120 (FIG. 3) which engages a cam follower 122 (FIG. 2) to effect movement of the shuttle 48 at the same velocity as the front table 28. Thus, during the period of time required for the front clamp 72 to move through a distance which is at least as great as the difference between the thickness of the thickest book 54 in a range of thicknesses and the thinnest book in a range of thicknesses, the arc 120 (FIG. 3) of the cam 112 engages the follower 122 to mach the velocity of the shuttle 48 to the velocity of the front table 28.

In one specific embodiment of the present invention, a pair of cam followers, corresponding to the cam follower 122, are mounted on arms 121 and 123 mounted on opposite sides of the cam 112. A pair of links extend between the arms 121 and 123. Springs are connected with the links to urge the cam followers into engagement with opposite sides of the cam 112, in the manner indicated schematically by spring 125 in FIG. 2. Of course, many other known arrangements could be used to press one or more cam followers against the cam 112.

Figure 2:
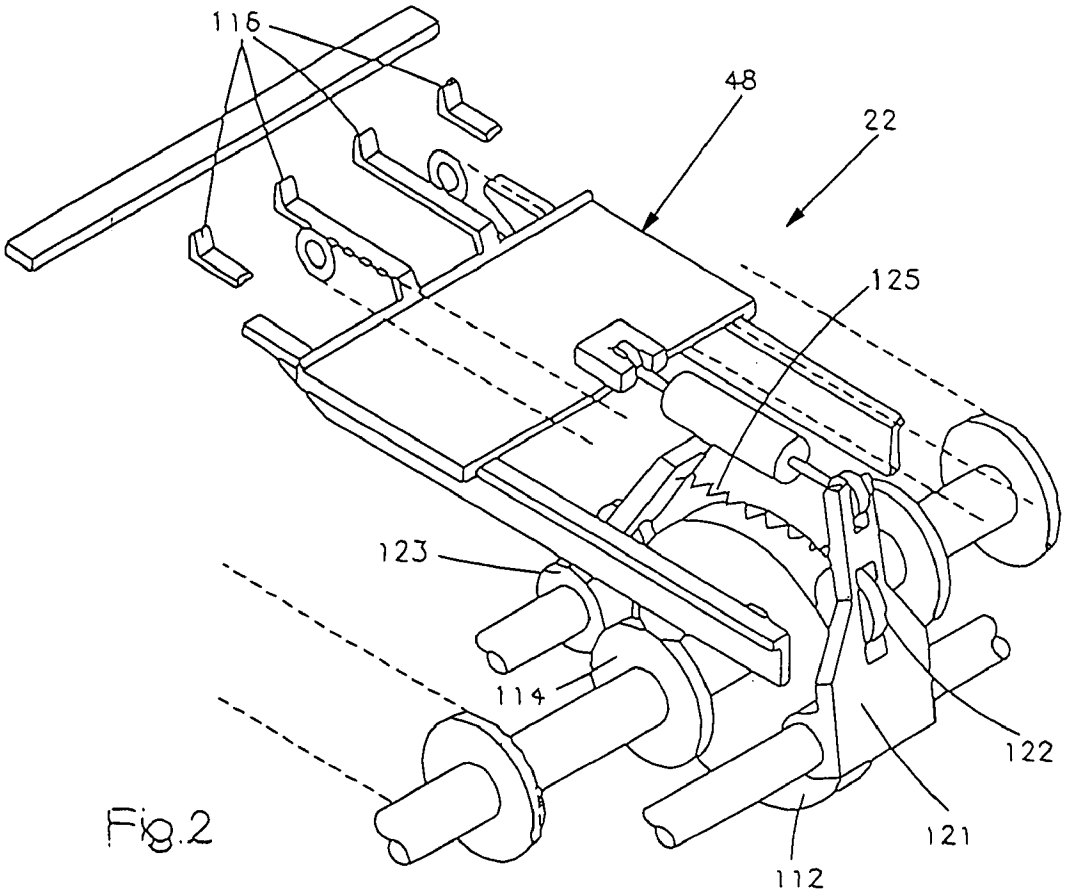
FIG. 2 is a schematic illustration depicting the construction of an infeed element or shuttle which moves a leading edge portion of a sheet material article into engagement with backstops.

After the front clamp member 72 has gripped the book to hold the book against movement relative to the front table 28 and backstops 62, the shuttle 48 is moved through a return stroke, that is, toward the right as viewed in FIG. 2, by the main cam 112. During movement of the shuttle through the return stroke by the main cam 112, an arc 124 (FIG. 3) on the main cam 112 engages the cam follower 122 (FIG. 2) to move the shuttle 48 through the return stroke. After the shuttle 48 has moved through the return stroke, the arc 126 (FIG. 3) on the main cam 112 engages the follower 122 to effect movement of the shuttle 48 through a forward shuttle.

During the forward stroke of the shuttle, the next succeeding book is moved onto the front table 28 and into engagement with the backstops 62. The cam arc 120 then engages the cam follower 122 to effect movement of the shuttle 48 and the book at the same velocity as the front table 28 in the manner previously explained.

The matched velocity effect according to the present invention has herein been described as being achieved using at least one cam follower engaged by a main cam driven by the main trimmer drive. In other embodiments of the present invention, one or more servo motors could be used instead to effect the movement of the infeed shuttle in accordance with the present invention. Details of construction of such a system would be apparent to those skilled in the art.

Front Trimmer Assembly

The front table 28 (FIG. 4) includes a frame 132 which is reciprocated through forward (leftward as viewed in FIG. 4) and return (rightward as viewed in FIG. 4) strokes by a front table drive assembly 134. The front table drive assembly 134 reciprocates the frame 132 of the front table 28 through one complete forward and return stroke for each machine cycle of the trimmer apparatus 20. Thus, for each cycle of operation of the trimmer apparatus 20, the front table 28 moves through one complete forward and return stroke.

The frame 132 of the front table 28 is supported for reciprocating movement by upright rocker links 140, 142, 144, and 146 which are pivotally connected to the frame 132 and the base 64. The table drive assembly 134 includes a pair of cranks which are connected with the drive shaft 150. The drive shaft 150 is rotated about its central axis by the main trimmer drive. Rotation of the cranks in the table drive assembly 134 causes a drive link 154 to reciprocate axially and to oscillate about the central axis of the main drive shaft 150. The drive arrangement for moving the frame 132 of the front table 28 is the same as is described in the aforementioned U.S. Pat. No. 3,733,947.

The front knife 26 is mounted on the frame 132 of the front table 28. Therefore, the front knife 26 moves through forward and return strokes with the frame 132 of the front table. In addition, the front knife 26 is movable vertically up and down relative to the frame 132 of the front table to trim the front edge portion of a book 54 with a chop cut.

A front knife frame 158 is fixedly secured to the table frame 132. The front knife frame 158 has upright guides which guide vertical movement of the front knife 26 during trimming of the front edge portion of a book. A lower knife 162 is fixedly connected with the front table frame 132 and cooperates with the movable front knife 26 to trim the front edge portion of a book 54 as the front knife is lowered. The front knife drive mechanism 166 is the same as is described in the aforementioned U.S. Pat. No. 3,733,947.

As the table frame 132 is being moved relative to the base 64 by the front table drive assembly 134, a front knife drive mechanism 166 is operable to reciprocate a knife drive link 168 connected with the movable front knife 26. The front knife drive mechanism 166 includes an eccentric (crank) which is driven by the drive shaft 150 to move the knife drive link 168 up and down as the front table 28 moves relative to the base 64.

The backstops 62 engage the back of a book to register the book relative to the front knife 26. The backstops 62 are mounted on the front table frame 132 for movement therewith relative to the base 64. The backstops 62 rotate (in a counterclockwise direction as viewed in FIG. 5) from a location beneath the path of travel of books through the sheet material trimming apparatus 20 into the path of movement. As the backstops 62 move into the path of travel of the books 54, the backstops are rotated in a forward (leftward as viewed in FIG. 5) direction relative to the table 28. The books 54 are also moving in a forward (leftward) direction. Therefore, the backstops 62 are moved forwardly into the space between a partially trimmed book and the next succeeding untrimmed book. At this time, the books 54 and backstops 62 are moving in the same forward direction.

When the backstops 62 rotate from a position immediately beneath the path of travel of the books and into the path of travel, the front table 28 is moving through a return stroke, that is toward the right as viewed in FIGS. 4 and 5. Thus, rotation of the backstops 62 upwardly into the path of movement of the books is in a direction which is opposite to the direction of movement of the front table 28. The combination of forward (leftward) movement of the backstops 62 relative to the front table 28 and return (rightward) movement of the front table enables the backstops to follow a partially trimmed book being moved off the front table as the back stops are moved to the raised position. Since the backstops follow a partially trimmed book which is moving off the front table, the backstops can move into a relatively small space between the books.

To lower the backstops 62, the counterclockwise rotation (as viewed in FIGS. 4 and 5) of the backstops is continued while a book 54 is clamped in a registered position on the front table. 28. The movement of the backstops 62 to the lowered position occurs while the front table 28 is moving forwardly (leftwardly). Therefore, the backstops 62 are moving in the same direction as the front table 28. The front trimming operation is being completed while the backstops 62 are moving from the raised or extended position to the lowered position. Therefore, there is ample time and space for movement of the backstops between adjacent books 54.

Each of the backstops 62 is rotated relative to the front table 28 by the intermittent drive mechanism 68 (FIG. 5). The position of the intermittent drive mechanisms relative to the front table 28 can be adjusted to adjust the distance between the side surfaces 174 on the backstops and the front knife 26. Thus, when the backstops 62 are in the extended or upright position shown in solid lines in FIG. 5, the intermittent drive mechanisms 68 and the backstops 62 can be moved n rightwardly (as viewed in FIG. 5) toward the front knife 26 to the position shown in dashed-dot-dashed lines in FIG. 5. Since the back or leading edge of a book engages the surfaces 174 on the backstops 62, changing the distance between the surfaces 174 on the backstops 62 and the front knife 26 changes the width of the trimmed book.

To move the intermittent drive mechanisms 68 and backstops 62 relative to the front table 28, a worm 178 (FIG. 5) is manually rotated to rotate a worm gear 180 connected with a threaded shaft 182. The threaded shaft 182 is connected with the intermittent drive mechanisms 68. Therefore, rotation of the threaded shaft 182 results in simultaneous movement of both of the intermittent drive mechanisms 68 either toward or away from the front knife 26.

The intermittent drive mechanisms 68 are continuously driven from the main trimmer drive through a pair of drive trains one of which is indicated at 190 in FIG. 5. Although only a single drive train 190 is shown in FIG. 5, it should be understood that a pair of drive trains 190 are provided to drive a pair of intermittent drive mechanisms 68 connected with a pair of backstops 62. The drive train 190 is constructed so that movement of the intermittent drive mechanism 68 toward or away from the front knife 26 does not actuate the intermittent drive mechanism.

If the drive train 190 actuated the intermittent drive mechanism 68 when the intermittent drive mechanism is moved relative to the front table 28, actuation of the intermittent drive mechanism would be either retarded or advanced relative to the operating cycle of the sheet material trimming apparatus 20. Of course, this would result in an out-of-phase relationship between movement of the backstops 62 by the intermittent drive mechanism 68 and operation of other components of the sheet material trimming apparatus 20.

The drive train 190 transmits force from an input member 194 which is continuously driven by the main trimmer drive. The input member 194 is a sprocket which drives a chain 196. The chain 196 in turn continuously drives a second sprocket 198 which drives a second chain 200. The chain 200 continuously drives a sprocket 202 connected with an input for the intermittent drive mechanism 68.

The sprockets 194, 198 and 202 are all of the same size. Therefore, the main trimmer drive rotates the sprocket 194 through a single revolution, the sprocket 198 and the sprocket 202 also rotate through one revolution. Since there is a one-to-one drive ratio for the drive train 190, the intermittent drive mechanism 68 is not actuated when the position of the intermittent drive mechanism is adjusted relative to the front table 28. This allows the drive train 190 to remain in an engaged or operating condition while the position of the intermittent drive mechanism 68 is adjusted.

When the position of the intermittent drive mechanism 68 is moved from the position shown in solid lines in FIG. 5 to the position shown in dashed-dot-dashed lines in FIG. 5, links 206 and 208 are pivoted. As the links 206 and 208 pivot, the sprockets 198 and 202 move relative to the front table 28. As the links 206 and 208 and sprockets 198 and 202 move relative to the front table, the sprockets 202 and 198 roll on the chains 200 and 196. However, the sprockets 198 and 202 do not rotate about their central axes. Therefore, the input to the intermittent drive mechanism 68 is not actuated as the intermittent drive mechanism is moved relative to the front table 28 even though the drive train 190 is not disengaged from the intermittent drive mechanism.

The intermittent drive mechanism 68 includes a pair of dwell arcs 210 and 212 on an input or cam element 214 (FIGS. 6 and 7). The cam element 214 is continuously rotated by the main trimmer drive through the drive train 190 during operation of the apparatus 20. A pair of gear segments 217 and 217 are fixedly connected to the cam element 214 for rotation therewith. An output element 218 has two pair of follower rollers 220, 222, 224 and 226 which sequentially engage the arcuate peripheral surfaces or dwell arcs 210 and 212 of the cam element 214 to hold the output element 218 against rotation relative to the cam element. A circular spur gear 232 connected with the output element 218 is sequentially engaged by the gear segments 216 and 217 as the cam element 214 and gear segments are rotated relative to the output element 218.

As the input or cam element 214 and gear segments 216 and 217 are rotated in a counterclockwise direction as viewed in FIG. 7, an acceleration roller 234 connected with the cam element 214 moves into engagement with a slot 236 (FIG. 7) in the output element 218. Immediately thereafter, the dwell arc 210 on the cam element 214 moves out of engagement with the follower roller 226 on the output element 218. Engagement of the acceleration roller 234 with the cam slot 236 then initiates clockwise rotation of the output element 218 and meshing engagement between the spur gear 232 and gear segment 217. Continued rotation of the cam element 214 rotates the output element 218 through one half of a revolution.

As the output element 218 is rotated through the final portion of 180° or one-half of a revolution, a second acceleration roller, that is the roller 235 in FIG. 7, moves into engagement with a second slot 240 in the output element 218. The follower rollers 220 and 222 then move into engagement with the dwell arc 212 on cam element 214. The dwell arc 212 on the cam element 214 then cooperates with the follower rollers 220 and 222 to hold the output element 218 against rotation. The output element 218 rotates through one half of a revolution during 90° if a trimmer operating cycle. The follower rollers 220 and 222 cooperate with the dwell arc 212 to hold the output element 218 stationary for the next 90° of a trimmer operating cycle.

As the input or cam element 214 continues to rotate in a counterclockwise direction as viewed in FIG. 7, an acceleration roller 236 connected with the cam element 214 moves into engagement with a slot 242 in the output element 218. Immediately thereafter, the dwell arc 212 moves out of engagement with the follower roller 220 on the output element 218. Engagement of the acceleration roller 236 with the cam slot 242 then initiates clockwise rotation of the output element 218 and meshing engagement between the spur gear 232 and gear segment 216. Continued rotation of the cam element 214 rotates the output element 218 through one half of a revolution.

As the output element 218 is rotated through the final portion of the second one-half of a revolution, an acceleration roller 237 moves into engagement with a slot 242 in the output element 218. The follower rollers 224 and 226 then move into engagement with the dwell arc 210 (FIG. 7) on the cam element 214. The dwell arc 210 on the cam element 214 then cooperates with the follower rollers 224 and 226 to lock the output element 218 against rotation. The output element 218 rotates through a second half of a revolution during 90° of a trimmer operating cycle. The follower rollers 224 and 226 cooperate with the dwell arc 210 to hold the output element 218 stationary for the next 90° of a trimmer operating cycle.

The output element 218 of the intermittent drive mechanism 68 is connected with the backstops 62. Therefore, for each complete revolution of the input cam 214 by the drive train 190 and each complete cycle of operation of the apparatus 20, the backstops 62 are rotated from the raised position to the lowered position and then back to the raised position. Thus, during 90° of rotation of the input element 214 and operating cycle of the apparatus 20, the follower rollers 224 and 226 engage the dwell arc 210 and lock the backstops in their raised position. During the next 90° of rotation of the input element 214 and operating cycle of the apparatus 20, the output element 218 is rotated through 180° to move the backstops 62 to their lowered position. The backstops are locked in their lowered position for the next 90° of rotation of the input element. During the next 90° of rotation of the input element 214 and operating cycle of the apparatus 20, output element 218 and backstops 62 are again rotated through 180° to move the backstops to their raised positions.

The indexing of the backstops 62 is coordinated with rotation of the main trimmer drive. Thus, the backstops 62 are indexed from a raised position (FIG. 15), in a counterclockwise direction (FIGS. 16 and 17), to a lowered position during 90° of a cycle of the trimmer apparatus 20. The backstops 62 remain in the lowered position of FIG. 18 during the next 90° of rotation of the main trimmer drive shaft. The backstops 62 then move from the lowered position back to the raised position during the next 90° rotation of the trimmer drive shaft. The backstops remain in the raised position for the following 90° of rotation of the main trimmer drive shaft.

In one specific embodiment of the present invention, the intermittent drive mechanism 68 was obtained from Cyclo-Index, a division of Leggett & Platt, Inc., of 524 W. Eldorado St., Carthage, Mo. 64836, U.S.A., under Model No. 90-1/2. However, it should be understood that other known types of intermittent drive mechanisms could be used if desired. The specific construction of the intermittent drive mechanism 68 has been set forth herein only for purposes of clarify of description.

In other embodiments of the present invention, one or more servo motors could be used instead of intermittent drive mechanism 68 to effect the rotating motion of the backstops 62 in accordance with the present invention. For example, the backstops 62 could be mounted directly on an output shaft of a servomotor. The servomotor could be controlled to provide a desired velocity profile, as in an "electronic cam" device. Details of construction of such a system would be apparent to those skilled in the art.

Although the backstops 62 and intermittent drive mechanism 68 have been disclosed herein as forming a portion of the front trimmer assembly 24, they could be used in other known types of sheet material handling apparatus. For example, the backstops 62 and intermittent drive mechanism 68 could be used to register sheet material relative to a printer.

The moveable front clamp 72 and its drive mechanism 74 (FIG. 8) are connected with the front table 28 for movement therewith relative to the base 62. Thus, the front clamp 72 moves through forward and return strokes with the front table 28. In addition, the upper front clamp 72 moves toward and away from the lower front clamp 76 which is fixedly connected to the front table 28. The clamp drive assembly 74 moves the upper clamp member 72 down to grip a book 54 while the book is held against the backstop 62 by the shuttle 48. After a front trim operation has been completed, the drive mechanism 74 moves the front clamp 72 upwardly relative to the table 28 to release the partially trimmed book.

The clamp drive mechanism 74 includes a cam 244 which is driven by the main trimmer drive to actuate a linkage 245. The linkage 245 includes a vertically moveable link 246 which is guided by a linear bearing 247 on the front knife table 28. An upper end portion of the link 246 is connected with the front clamp 72. A lower end portion of the link 246 is connected with a drive link 241 by a scotch yoke 248.

When the front clamp 72 closes against a thick book 54, the front clamp is moved downwardly through a relatively short distance by link 246. However, when the front clamp 72 closes against a thin book 54, the front clamp 72 must move downwardly through a relatively large distance. A spring 249 is provided in the linkage 74 to enable a cam follower 250 to remain in engagement with the cam 244 when the front clamp 72 engages a thick book 54. Thus, when the front clamp 782 engages a thick book 54, the spring 249 stretches, effectively lengthening a link 251 in the linkage 245.

The spring 249 includes a housing which holds a stock of Belleville spring washers. The washer housing is connected with a lower section of the link 251. An upper section of the link 251 extends through openings in the stock of Belleville spring washers. The upper section of the link 251 has a flange which compresses the Belleville spring washers against a flange on the upper end of the housing to lengthen the link 251. Of course, other known types of springs could be used if desired.

Although the front trimmer assembly 24 has been described in association with the side trimmer assembly 34, the front trimmer assembly could be used without the side trimmer assembly if desired. Of course, if this was done, the books 54 would only be trimmed along their front edge portions by the front trimmer assembly 24. A separate apparatus would have to be used to trim the head and tail edge portions of the book. Although the front trimmer assembly 24 is of the flying trimmer type and has a movable front table 28, the backstops 62, drive mechanism 68 and other features of the front trimmer assembly could be used with a stationary front table if desired.

Transfer Belt Assembly

The transfer belt assembly 30 (FIG. 9) moves partially trimmed books 54 from the front table 28 to the side table 44, and moves trimmed books from the side table 44 to the receiving conveyor 36. To prevent damage to the books, the transfer belts in the transfer belt assembly 30 move at the same speed as the front table 28 when gripping a partially trimmed book at the front table. The transfer belts move at the same speed as the side table 44 during clamping, cutting and unclamping of books at the side table. The velocity of the books may be varied for remaining portions of the machine cycle so as to achieve the correct amount of book travel for each cycle.

The transfer belt assembly 30 includes a continuous upper belt 254 which engages an upper major side surface 1204 (FIG. 17) of a book 54 being gripped and/or transported by the transfer belt assembly 30. The transfer belt assembly 30 also includes a continuous lower belt 256 (FIG. 9) which engages lower major side surfaces of the books being gripped and/or transported by the transfer belts.

The epicyclic gear unit 88 continuously drives the upper and lower belts 254 and 256 at speeds which vary during movement of a book through the sheet material trimming apparatus 20. Thus, the upper and lower belts 254 and 256 are driven at the same speed as the front table 28 during initial engagement of a book disposed on the front table. The upper and lower belts 254 and 256 are drive at the same speed as the side table 44 during a side trimming operation. The transfer belts 254 and 256 are then accelerated to a speed which exceeds the speed of the front and side tables 44 and 28 to move trimmed books at the same speed as the receiving conveyor 36 at the outlet from the sheet material trimming apparatus 20.

The upper belts 254 extend along a continuous path around a drive pulley 260 (FIG. 9) which is continuously rotated by the epicyclic gear unit 88. The upper transfer belt 254 extends from the drive pulley 260 along a guide track 262. The outer end portion 86 of the guide track 262 is pivotal relative to the lower belt 256 to open and close a nip 263 at which books are gripped while they are being moved by the front table 28.

The lower drive belt 256 extends around a lower drive pulley 266 and around a belt guide 268. The lower transfer belt 256 is continuously driven by the epicyclic gear unit 88 at the same speed as the upper transfer belt 254. In other embodiments of the present invention, instead of using the belts 254 and 256 as the transfer elements other known transfer elements could be used if desired. For example, a shuttle mechanism could be used, the construction details of which would be apparent to those skilled in the art.

The epicyclic gear unit 88 has two inputs and one output. A constant speed member to the epicyclic gear unit 88 (not shown) is continuously driven at a constant speed by a main trimmer drive. A variable speed input member 272 to the epicyclic gear unit 88 is oscillated by the cam 94. Oscillations of the input member 272 to the epicyclic gear unit 88 result in the speed of the output member 92 varying even though main trimmer drive speed remains constant.

In one specific embodiment of the present invention, the epicyclic gear unit 88 was obtained from Andantex, Inc. of Ocean Township, N.J., U.S.A. and was designated as Model No. SA42. Of course, other known variable speed drive units could be used if desired. For example, in other embodiments of the present invention one or more servo motors could be used instead to effect the movement of the belts 254 and 256 in accordance with the present invention. Details of construction of such a system would be apparent to those skilled in the art.

The support structure for the transfer belts 254 and 256 is mounted on the frame 64 and remains generally stationary. However, the inlet end portion 86 of the transfer belt assembly 30 is movable between a raised position (FIG. 14) and a lowered portion (FIG. 9). When the inlet portion of the transfer belt assembly cannot engage a book on the front table 28. When the inlet portion 86 of the transfer belt assembly 30 is in the lowered position of FIG. 9, the transfer belt assembly is effective to grip a book at the front table 28.

The transfer belts 254 and 256 extend from the front trimmer assembly 24 (FIG. 1) through the side trimmer assembly 34 to the receiving conveyor 36. After the forward end portion 86 of the transfer belt assembly 30 has engaged a book, the book is continuously gripped by the transfer belts 254 and 256 until the book is released to the receiving conveyor 36.

During operation of the apparatus 20, the transfer belts 254 and 256 are continuously driven at a common speed. The lower run of the upper transfer belt 254 and the upper run of the lower transfer belt 256 continuously move in a forward direction, that is toward the left as viewed in FIG. 9. Therefore, once a partially trimmed bok 54 has been engaged by the transfer belts 254 and 256 at the front trimmer assembly 24, the book is continuously moved in a forward direction, that is toward the left as viewed in FIG. 9, by the transfer belts 254 and 256.

The speed of movement of the transfer belts 254 and 256 is varied by the epicyclic gear unit 88 to match the speed of movement of the front table 28 when a book 54 disposed on the front table 28 is initially gripped by the transfer belts 254 and 256. The speed of the transfer belts 254 and 256 is varied to match the speed of movement of the side table 44 when a book 54 gripped by the transfer belts is being trimmed by the side trimmer assembly 34. When a book 54 is discharged from the transfer belt assembly 30, the speed of movement of the book and the transfer belts 254 and 256 matches the speed of the receiving conveyor 36.

The books 54 which are trimmed with the apparatus 20 may have a thickness which varies within a range of thicknesses. Therefore, the transfer belts 254 and 256 must be effective to grip both relatively thick and relatively thin books. To enable the transfer belts 254 and 256 to grip both thick and thin books, the upper belt 254 is yieldable.

The outer side surface of the lower run of the upper belt 254 is separated from the upper side surface of the upper run of the lower belt 256 by a distance which is slightly less than the thickness of the thinnest book 54 in the range of thicknesses. Therefore, the upper belt 254 will press a thin book 54 against the lower belt 256 with sufficient force to grip the thin book. The upper belt 254 is yieldable so that the thickest book in the range of thicknesses can be gripped between the upper belt and the lower belt 256. Thus, when a thick book 54 is disposed between the upper and lower belts 254 and 256, the upper belt 254 is resiliently deflected upwardly by the thick book to accommodate the thick book.

In one embodiment of the present invention, the upper belt 254 had webs of yieldable material interconnecting a toothed timing base belt and a continuous outer layer. The outside side surface of the outer layer engages the upper side surface of a book when the book is disposed between the upper and lower belts 254 and 256. The webs of resilient material are deflected by a relatively small amount by a thin book and are deflected by a relatively large amount by a thick book.

In this particular embodiment of the present invention, the transfer belt 254 was made by a two-stage process to mold a urethane cover to a polyurethane timing or base belt. The base belt was a self-tracking timing belt with steel tension members and was made by Plastimatic, Inc. of 3 Oak Road, Fairfield, N.J., U.S.A. and was given Plastimatic Part No. 38.1 HK/2286V. The urethane cover was one inch thick and was cast to the base belt.

The urethane cover included a continuous outer side surface which would engage the books and a plurality of webs of urethane extending between the base belt and the outer layer. Air pockets or open spaces were formed in the belt. A relatively thick book would cause the resilient webbing to deflect and decrease the size of the open spaces in the belt.

The upper transfer belt 154 may be urged toward the lower transfer belt by engagement of shoes against an upper side surface of the lower run of the conveyor belt. When a relatively thin book is being transported between the belts, the lower run of the upper belt is pressed against the upper side surface of the books by the shoes. A relatively thick book would merely deflect the belt to a greater extent against the influence of the biasing pressure on the shoes. A belt which is biased in this manner is disclosed in U.S. Pat. No. 3,811,350. Other known types of transfer belts assemblies could be utilized if desired.

Side Trimmer Assembly

The side table 44 (FIG. 10) moves through a complete forward stroke (toward the left as viewed in FIG. 10) and through a complete return stroke (toward the right as viewed in FIG. 10) during each cycle of operation of the trimmer apparatus 20. The side table 44 is supported for reciprocating movement by a pair of upright support members or rocker links 282 and 284. Although only the two rocker links 282 and 284 have been shown in FIG. 10, it should be understood that there is a corresponding pair of rocker links on the opposite side of the table.

The side knives 40 and 42 (FIGS. 1 and 10) are connected with the table 44 and move through forward and return strokes with the table. In addition, the side knives 40 and 42 are movable toward and away from the side table 44 to trim a book 54 disposed on the table. A clamp member 102 (FIG. 11) is associated with the side knife 42. A similar clamp member (not shown) is associated with the side knife 44.

A side table drive mechanism 290 (FIG. 10) is operable to effect reciprocating movement of the side table 44 through the forward and return strokes relative to the base 64 of the trimmer apparatus 20. The side table drive mechanism 290 includes a crank which is continuously rotated by the main trimmer drive. Rotation of the cranks moves a side table drive link 292 toward the left (as viewed in FIG. 10) to move the side table 44 through a forward stroke and toward the right to move the side table 44 through a return stroke. The general construction of the side table drive mechanism 290 is the same as is disclosed in the aforementioned U.S. Pat. No. 3,733,947.

As the side table 44 moves through a return stroke, the transfer belt assembly 30 (FIG. 9) moves a partially trimmed book onto the side table 44. After the partially trimmed book has been moved onto the side table 44, the speed of the upper and lower transfer belts 254 and 256 matches the speed of the side table as the side table moves through a major portion of a forward stroke. The side clamps 102 move with the side table 44.

After a book has been moved onto the side table 44 by the transfer belts 254 and 256, the side clamps 102 grip the book adjacent to the side knives 40 and 42. At this time, the side knives 40 and 42, book 54, side table 44, and side clamps 102 are all moving at the same speed in the forward direction (that is toward the left as viewed in FIG. 10). The velocity of the transfer belts 254 and 256 matches the velocity of the side table 44 during the side trimming operation which is performed while the side table is moving through a forward stroke.

The side knives 40 and 42 cut the moving book with a shearing action. To provide a shearing action, the side knives 40 and 42 move downwardly toward the table 44 along a path which extends transversely to the upper major side surface 204 of a book 54. Thus, the side knives 40 and 42 move downwardly along paths having vertical components which extend perpendicular to the path of movement of the books through the apparatus 20 and horizontal components which extend parallel to the longitudinal axis of the path of movement of the books through the apparatus 20. This results in a cutting of a book 54 with a shearing action.

The side knives 40 and 42 are pulled downwardly by a side knife drive mechanism 300. The side knife drive mechanism 300 includes a crank which is disposed on the same shaft as the eccentric in the side table drive mechanism 290. The side knife drive crank is continuously rotated by the main trimmer drive and, after the side clamps 102 have firmly gripped a book on side tale 44, move a knife actuator link 304 downwardly. A swing link 306 is connected with the same knife 42.

Due to the effect of the swing link 306, the side knife 42 moves downwardly and toward the right (as viewed in FIG. 10) as the knife actuator link 304 is moved downwardly by the crank in the knife drive mechanism 300. Although only the swing link 306 and drive link 304 for the side knife 42 have been shown in FIG. 10, it should be understood that similar swing and drive links are connected with the side knife 40 to move the side knife 40 downwardly and toward the right (as viewed in FIG. 10) with the side knife 42.

After the opposite side edges of the book have been trimmed by the side knives 40 and 42, the side knives are raised back to their original position above the side table 44. Side clamps 102 are released by the side clamp actuator mechanism 106 (FIG. 11) on sheet 5 of the drawings. During the latter part of the forward stroke of the side table 44, the transfer belts 254 and 256 start to move the fully trimmed book off of the side table 44 toward the receiving conveyor 36.

The side clamp actuator mechanism 106 (FIG. 11) is mounted on and moves with the side table 44. The side clamp actuator mechanism 106 includes a cam 312. The box cam 312 is continuously rotated by the main trimmer drive. The linkage 314 (FIG. 11) transmits force from the cam 312 to the side clamp 102. The cam 312 actuates the linkage 314 to lower the side clamp 102 immediately before the side knife 42 cuts the edge portion of a book 54 adjacent to the side clamp. After the side knife 42 has been retracted, the cam 312 actuates the linkage 314 to raise the clamp 102.

The linkage 314 includes a pair of vertical links 318 and 320 which are connected to the clamp 102. Reciprocation of the links 318 and 320 is guided by a pair of linear bearings 322 and 324 disposed on the side table 44. Bell cranks 326 and 328 are connected to the links 328 and 320 by connector links 330 and 332. The bell cranks 326 and 328 are actuated by rotation of the cam 312.

The side clamp 102 effective to hold either thick or think books 54 against movement relative to the side table 44. To compensate for the different book thicknesses, springs 334 and 336 are provided in the connector links 330 and 332. When the clamp 102 engages a thick book 54, the clamp 102 moves downwardly through a relatively short distance and the springs are compressed to increase the effective length of the connector links 330 and 332. When the clamp 102 engages a thin book, the springs 334 and 336 are only slightly compressed and the effective length of the connector links 330 and 332 have the same construction as the spring 249 (FIG. 8) in the front clamp linkage 245.

Figure 11:
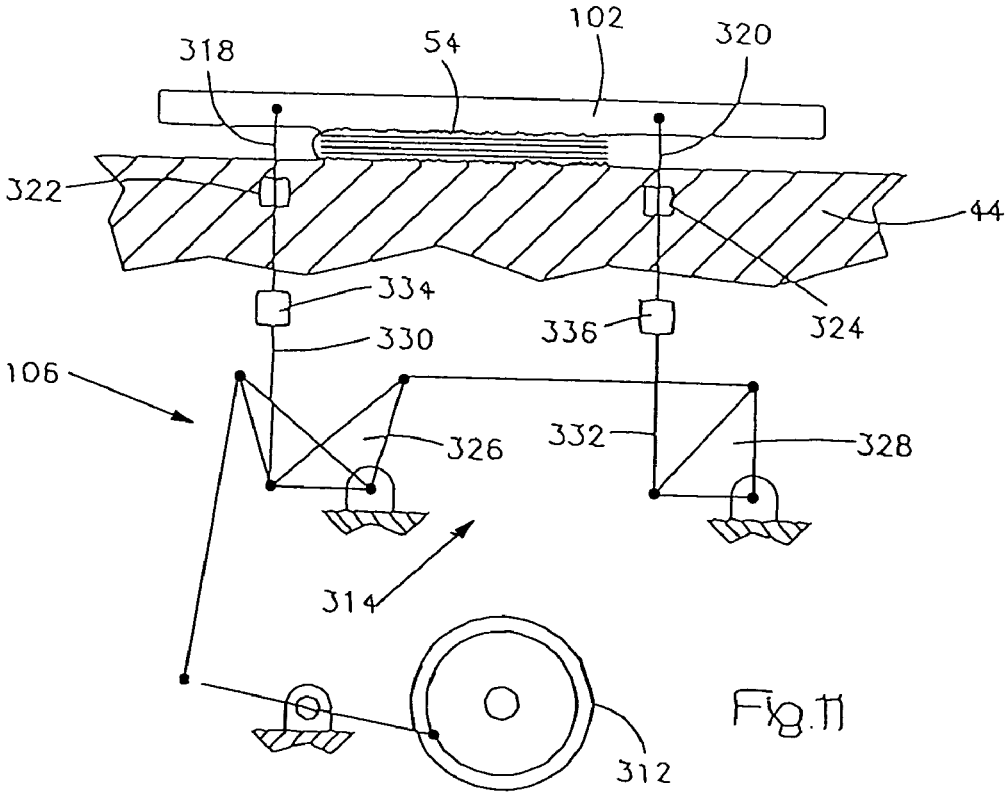
FIG. 11 (on sheet 5 of the drawings) is a highly schematicized illustration depicting the construction of side clamps and a mechanism for moving the side clamps in the side trimmer assembly of FIG. 10.

Although the clamp 102 associated with the side knife 42 and its actuator mechanism 106 have been shown in FIG. 11, it should be understood that a similar clamp and actuator mechanism are associated with the side knife 40.

Operation

Figure 12:
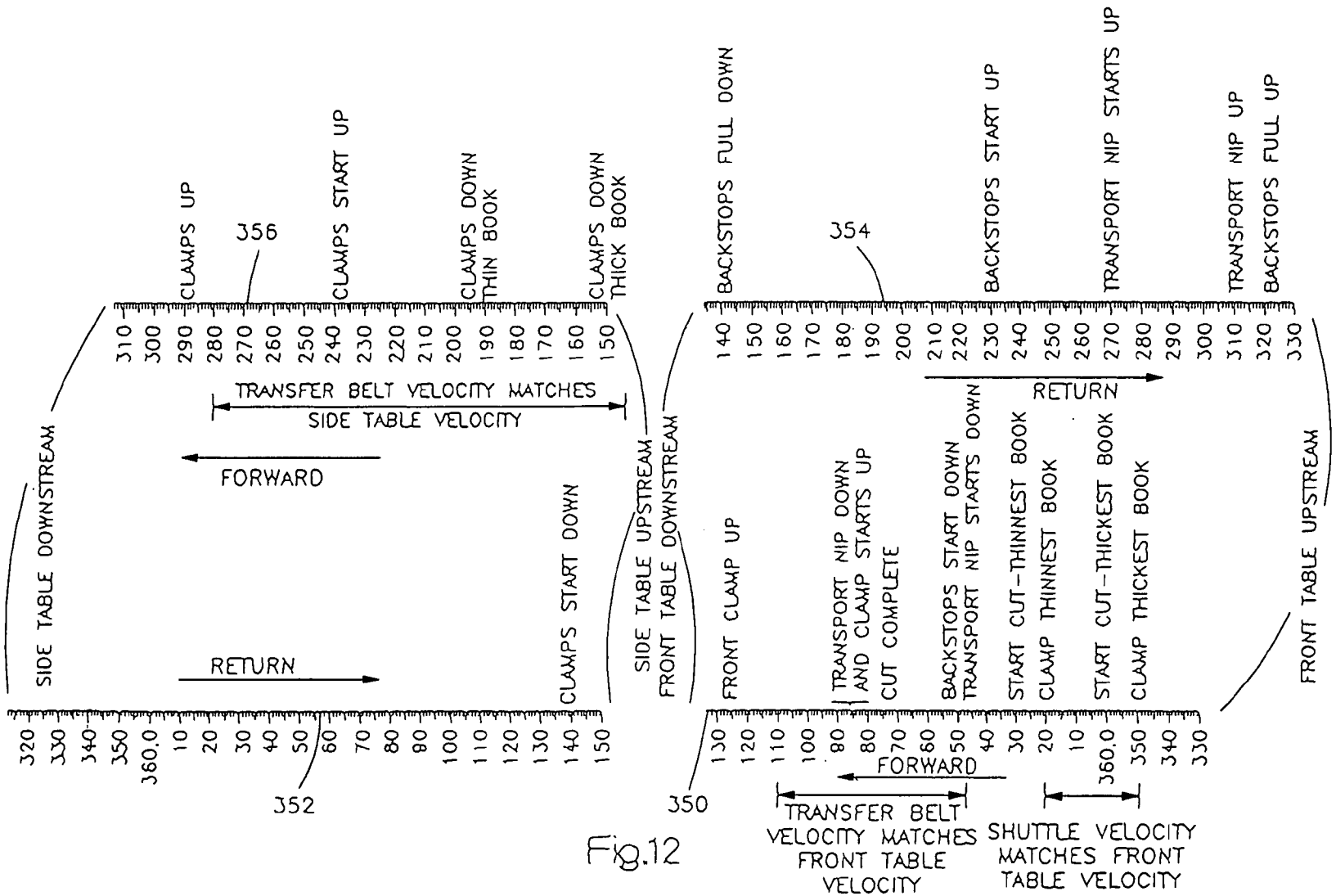
FIG. 12 is a chart which schematically depicts the relationship between tables in the front and side trimmer assemblies and the occurrence of various events during operation of the apparatus of FIG. 1.

FIG. 12 is a graph illustrating the relative positions of the front and side tables 28 and 44 during a machine operating cycle. In general, the front table 28 moves through a forward stroke, indicated by a line 350 in FIG. 12, while the side table 44 is moving through a return stroke, indicated by a line 352 in FIG. 12. The front table 28 moves through a return stroke, indicated by a line 354 in FIG. 12, while the side table 44 moves through a forward stroke, indicated by a line 356 in FIG. 12.

Various events which occur during reciprocation of the front and side tables 28 and 44 have been indicated in FIG. 12. These events have been indicated as a function of a time of their occurrence in a 360° operating cycle of the trimmer apparatus 20. The zero degree (0°) position was arbitrarily selected to be the position in which the support or rocker links 140, 142, 144 and 146 for the front table 28 (FIG. 4) and the support or rocker links 182 and 184 for the side table 44 (FIG. 10) are approximately vertical. Of course, a different origin for the machine cycle could be selected if desired.

The front table 28 moves through a forward stroke, toward the left along the line 350 in FIG. 12, from approximately 330° through the origin or 0° to 134° of the machine cycle. The front table 28 moves through a return stroke, toward the right along the line 354 in FIG. 12, between 134° to 330° of the machine cycle. The side table 44 moves through a forward stroke, toward the left along the line 356 in FIG. 12, from 150° to 313° of the machine cycle. The side table 44 moves through a return stroke from 313° through the origin to 150° of the machine cycle, toward the right along the line 352 in FIG. 12.

The front and side trimming operations occur during forward strokes of the front and side tables 28 and 44. Thus, a book to be trimmed is moved into initial engagement with the back stops 62, is clamped, is cut, and is unclamped during a forward stroke of the front table. The partially trimmed book is removed from the front table 28 by the transfer belt assembly 30 during a return stroke of the front table.

Similarly, clamping, cutting and unclamping of a book at the side table 44 occurs during a forward stroke of the side table. Removal of the trimmed book from the side table 44 to the receiving conveyor 36 by the transfer belt assembly 30 occurs during a return stroke of the side table 44. In addition, the movement of the next succeeding book 54 onto the side table 44 occurs during the return stroke.

The forward and return strokes of the front and side tables 28 and 44 are approximately, but not exactly, 180° out of phase. Thus, the front table 28 is completing a return stroke as the side table 44 is completing a forward stroke. Similarly, the front table 28 is completing a forward stroke as the side table 44 is completing a return stroke.

Figure 13:
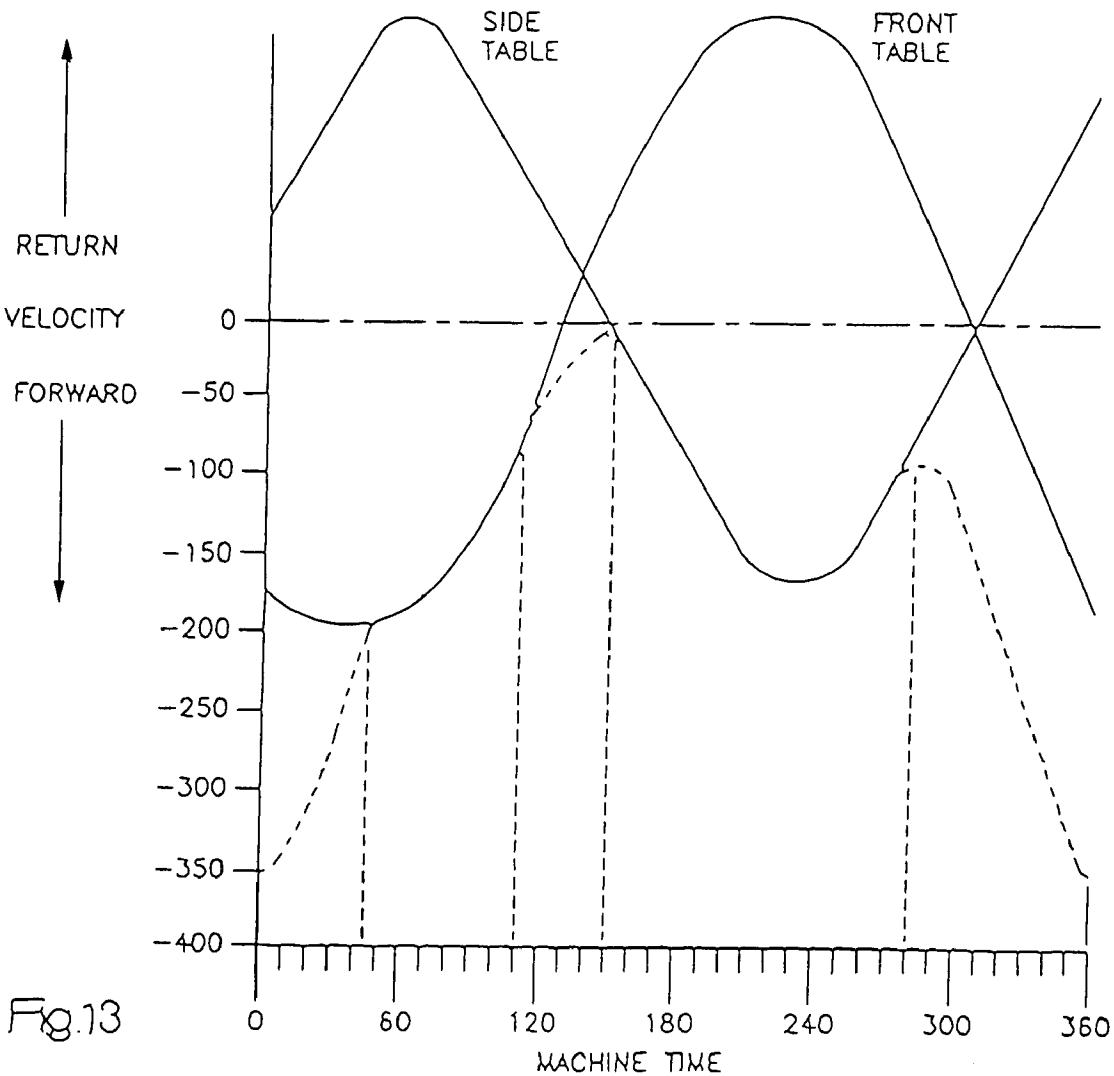
FIG. 13 is a graph illustrating the relationship between the speed of movement of the front table, the side table, and transfer belts during operation of the apparatus of FIG. 1.

The relationship between the speed of the front and side tables 28 and 44 and the speed of the transfer belts 254 and 256 through an operating cycle of trimmer apparatus 20 is shown by the graph in FIG. 13. The transfer belts 254 and 256 move at the same speed as the front table 28 from 46° to 110° of the machine cycle. The transfer belts 254 and 256 move at the same speed as the side table 44 from 150° to 280° of the machine cycle.

After a side trimming operation has been completed at 280° in the machine cycle, the speed of the belts 254 and 256 is increased in the forward direction to accelerate a completely trimmed book 54 and remove it from the side table 44. The speed of the belts 254 and 256 is increased to a maximum speed which is substantially greater than the maximum forward speeds of the front and side tables 28 and 44. This enables the fully trimmed books 54 to be delivered to the receiving conveyor 36 at any desired speed in a large range of speeds.

When the speed of movement of the transfer belts 254 and 256 matches the speed of movement of the receiving conveyor 36, the trimmed book 54 exists from between the transfer belts. Thus, the point of exit of a fully trimmed book 54 from between the transfer belts 254 and 256 is selected to coincide with a belt speed which matches the speed of the receiving conveyor 36. By changing the time at which a trimmed book 54 exists from between the transfer belts 254 and 256, the speed of movement of the book can be adjusted to correspond to different receiving conveyor speeds.

The relationship between the front and side tables 28 and 44 just after the beginning of a forward stroke of the front table and a return stroke of the side table is illustrated schematically in FIG. 14. Thus, FIG. 14 illustrates the relationship between various components of the trimming apparatus 20 at approximately 335° (FIG. 12) in the operating cycle of the apparatus.

At approximately 335° in the operating cycle of the apparatus 20, an untrimmed book 54 is being moved onto the front table 28 by shuttle 48 (FIG. 14). At this time, the leading or back edge 56 of the untrimmed book 54 is approaching the raised backstops 62. The front knife 26 and front clamp 72 are both raised. At this time, both the infeed shuttle 48 and the front table 28 are moving forward (toward the left as viewed in FIG. 14). However, the shuttle 48 is moving forward faster than the side table 28. This enables the shuttle 48 to push the untrimmed book 54 slowly forwardly relative to the side table 28 toward the backstops 62.

During the immediately preceding return stroke of the table 28, the backstops 62 were rotated in a counterclockwise direction (as viewed in FIG. 14) from a fully retracted position to the raised position shown in FIG. 14. Thus, the backstops 62 started to move from the fully lowered position (FIG. 18) at approximately 233° in the operating cycle (FIG. 12). The backstops were rotated in a counterclockwise direction to a fully extended position shown in FIG. 14 at approximately 323° (FIG. 12) in the operating cycle of the trimmer apparatus.

During the initial 90° of movement of the backstops 62 from a downwardly extending fully lowered position in a counterclockwise direction toward the fully raised position shown in FIG. 14, the backstops were beneath the path of travel of the books 54 through the apparatus 20. However, during the next 90° of counterclockwise rotation of the backstops 62, the backstops move into the path of movement of the books 54 through the apparatus 20. During movement of the backstops 62 into the path of travel of the books 54, the backstops 62 are moving in the direction of movement of the books, that is, toward the left as viewed in FIG. 14. This enables the backstops 62 to move into a relatively small space between the leading edge 56 of a book 54 moving onto the front table 28 and the trailing edge of a book moving off of the front table.

At the same time that the backstops 62 are rotating in a forward direction, that is toward the left as viewed in FIG. 14, into the path of travel of the books, the front table 28 is moving through are turn stroke, toward the right as viewed in FIG. 14. Thus, the backstops 62 are moving in the opposite direction from the table 28 when the backstops move into the path of travel of books. This also facilitates movement of the backstops 62 into a relatively small space between the books.

At this time, 335° in the operating cycle, the side table 44 (FIG. 14) is moving through a return stroke. A fully trimmed bok 54 is being moved off of the side table 44. The speed of the upper and lower transfer belts 254 and 256 (FIG. 9) is increasing (FIG. 13). The relationship between the front table 28 and side table 24 with an untrimmed book clamped to the front table 28 is illustrated in FIG. 15. At this time, a fully trimmed book is moving forwardly off of the side table 44. This occurs at approximately 20° in the operating cycle of the trimmer apparatus (FIG. 12).

The front clamp 72 closes on the thickest book 54 in a range of thicknesses at approximately 350° in the operating cycle of the apparatus (FIG. 12). The exact time when the front clamps 72 grips a book 54 depends on the thickness of the book. The velocity of the shuttle 48 matches the velocity of the front table 28 from the time when the clamp 72 would have engaged the thickest book in the range of thicknesses until the clamp would have engaged the thinnest book in the range of thicknesses. Engagement of the clamp 72 with the thickest book occurs at approximately 350° (FIG. 12) in the operating cycle of the apparatus 20. Engagement of the clamp 72 with the thinnest book occurs at approximately 20° in the operating cycle of the apparatus 20.

During the time which is required for the clamp 72 to move through a distance corresponding to the difference between the thickness of the thickest book in the range of thicknesses and the thickness of the thinnest book in the range of thicknesses, the shuttle 48 moves at the same velocity as the front table 28 and holds the back or leading edge of an untrimmed book 54 against the backstops 62 in the manner shown in FIG. 15. Since the untrimmed book 54 is held between the shuttle 48 and the backstops 62 at least until the clamp 72 closes on the book, accurate registration of the book is obtained relative to the front knife 26. The accuracy of the registration of the book 54 is not effected by the thickness of the book. Thus, either a thick book or a thin book is accurately registered relative to the front knife 26.

While the book 54 is being moved onto and clamped relative to the front table 28, the front portion 86 of the transfer belt assembly 30 remains raised so that the transfer belts 254 and 256 are clear of the book on the front table 28 (FIG. 15). However, the transfer belts 254 and 256 are moving a fully trimmed book 54 forwardly (FIG. 13) off of the side table 44 as the side table moves through a return stroke.

The front knife 26 starts to cut the thickest book 54 in the range of thicknesses at approximately 0° or 360° (FIG. 12) in the operating cycle. At this time, the shuttle 48 (FIG. 15) is still in engagement with the trailing edge 52 of the book 54 and is moving at the same velocity as the front table 28. The front knife starts to cut the thinnest book 54 in the range of thicknesses at approximately 30° (FIG. 12) in the operating cycle. At this time, the shuttle 48 is being retracted.

The relationship between the front table 28 and side table 44 immediately after a cut has been made by the front knife 26 is illustrated schematically in FIG. 16. At this time, the receiving conveyor 36 will have engaged a fully trimmed book 54 and will be moving it away from the transfer belt assembly 30. The events shown schematically in FIG. 16 occur at approximately 73° in the machine cycle (FIG. 12).

At this time, 73° in the machine cycle, the front knife 26 (FIG. 16) has completed a downward stroke toward the front table 28. Thus, the front edge portion of a book has been trimmed. The front clamp 72 still holds the book 54 against movement relative to the front table 28. The backstop 62 has started to rotate in a counterclockwise direction from the raised position of FIG. 15 toward the retracted position. In addition, the forward end portion 86 of the transfer belt assembly 30 is approaching a closed condition in which the upper and lower transfer belts 254 and 256 grips the book 54.

At this time, 73° in the operating cycle, the transfer belts 2564 and 256 are moving at the same speed as the front table 28 (FIGS. 12 and 13). Thus, the lower run of the upper transfer belt 254 (FIG. 9) is moving forwardly at the same speed as the front table 28. Therefore, the only relative movement between the transfer belts 254 and 256 and the book 54 is the result of a closing of the outer end portion of the transfer belts downwardly against the upper side surface 104 of the book.

FIG. 17 illustrates the relationship between the front table 28 and empty side table 44 while the front table is moving forward the 3nd of a return stroke. At this time, the front clamp 72 is moving toward a fully disengaged position. This occurs at approximately 100% (FIG. 12) in the operating cycle of the trimmer apparatus 20.

The upper and lower transfer belts 254 and 256 are still moving at the same speed as the front table 28 (FIG. 13). Thus, the transfer belts 254 and 256 are gripping a partially trimmed book 54 without moving the book relative to the front table 28. In addition, the backstops 62 are rotating in a counterclockwise direction toward their fully retracted position. The side table 44 is moving toward the end of a return stroke.

The relationship between the empty front table 28 and side table 44 during trimming of a book on the side table is illustrated schematically in FIG. 18. The events illustrated in FIG. 18 occur at approximately 215° (FIG. 12) in an operating cycle of the trimmer apparatus.

The front table 28 is empty and is moving through a return stroke. At this time, the shuttle 48 is engaging the next book to be moved onto the front table 28. The front knife 26 and front clamp 72 have been Moved to their fully raised positions. The backstops 62 are stationary relative to the front table 28 and are in a fully lowered or retracted position.

The side table clamps 102 (FIG. 11) have gripped the book 54 to hold the book against movement relative to the side table 44. In addition, the side knives 40 and 42 are moving downwardly and forwardly, in the manner indicated by the arrow 362 in FIG. 18, to trim the book 54 with a shear type cutting action. The transfer belts 254 and 256 are moving at the same speed as the side table 44. Therefore, there is no relative movement between the transfer belts 254 and 256 and the book moving with the side table 54. When the side trim cuts have been completed, both the side clamps 102 and the side knives 40 and 42 are retracted and the fully trimmed book is moved off of the side table 44 to the receiving conveyor 36 in the manner previously explained.

It will of course be understood that the present invention has been described above only by way of example and that modifications of details can be made within the scope of the invention.

What is claimed is:

1. A registration device for a sheet material article handler, the registration device comprising:

a movable backstop configured to sequentially engage a leading edge portion of a sheet material article moving in a direction of movement of the sheet material article along a path of movement of the sheet material article in the sheet material article handler so as to register the sheet material article relative to the sheet material article handler; and a driver configured to move the backstop along an arcuate path in the direction of movement of the sheet material article from a first position out of the path of movement to a second position in the path of movement, the driver being configured to rotate the backstop about an axis in a single angular direction so as to define the arcuate path, the axis being disposed at a movable table of the sheet material article handler;

the driver being configured to move the backstop along the arcuate path from the first position to the second position as the table is moving in a direction opposite the direction of movement of the sheet material article along the path of movement of the sheet material article.

2. The registration device as recited in claim 1 wherein the driver is configured to move the backstop along the arcuate path to the second position so as to follow a trailing edge of the sheet material article as the sheet material article moves along the path of movement of the sheet material article.

3. The registration device as recited in claim 1 wherein the driver is further configured to move the backstop further along the arcuate path from the second position to a third position out of the path of movement of the sheet material article.

4. The registration device as recited in claim 1 wherein the axis is capable of being repositioned relative to the table.

5. The registration device as recited in claim 4 wherein the sheet material article handler is a sheet material article trimmer and the movable table is a front trimmer table, the repositioning of the axis changing a distance between an engagement surface of the backstop and a knife of the front trimmer when the backstops are in the second position.

6. The registration device as recited in claim 1 wherein the arcuate path is circular.

7. The registration device as recited in claim 1 wherein the backstop includes an elongated member, the elongated member being disposed generally perpendicular to the path of movement of the sheet material article when the backstop is in the second position.

8. The registration device as recited in claim 1 wherein the driver includes an intermittent drive mechanism configured to move the backstop along the arcuate path in synchronization with the moving of the sheet material article along the path of movement of the sheet material article.

9. The registration device as recited in claim 8 wherein the intermittent drive mechanism is driven from a main drive of the sheet material article handler.

10. The registration device as recited in claim 1 wherein the driver includes a servo motor.

11. The registration device as recited in claim 1 wherein the sheet material article handler is a sheet material article trimmer.

12. The registration device as recited in claim 1 wherein the sheet material article handler is a sheet material article printer.

* * * * *